US009635911B2

(12) United States Patent
Moille

(10) Patent No.: US 9,635,911 B2
(45) Date of Patent: May 2, 2017

(54) ELASTIC ARTICULATION FOR HOROLOGICAL ASSEMBLY

(71) Applicant: ROLEX S.A., Geneva (CH)

(72) Inventor: Daniel Moille, Yvoire (FR)

(73) Assignee: ROLEX SA, Geneva (CH)

( * ) Notice: Subject to any disclaimer, the term of this patent is extended or adjusted under 35 U.S.C. 154(b) by 730 days.

(21) Appl. No.: 14/054,442

(22) Filed: Oct. 15, 2013

(65) Prior Publication Data

US 2014/0101899 A1 Apr. 17, 2014

(30) Foreign Application Priority Data

Oct. 16, 2012 (EP) ..... 12188657

(51) Int. Cl.

| | |
|---|---|
| ***A44C 5/00*** | (2006.01) |
| ***A44C 5/18*** | (2006.01) |
| ***A44C 5/14*** | (2006.01) |
| *A44C 5/24* | (2006.01) |

(52) U.S. Cl.

CPC ..... *A44C 5/185* (2013.01); *A44C 5/24* (2013.01); *A44C 5/243* (2013.01); *A44C 5/246* (2013.01); *Y10T 24/4782* (2015.01)

(58) Field of Classification Search

CPC ..... A44C 5/185; A44C 5/24; A44C 5/243; A44C 5/246

USPC ..... 224/164, 171, 174, 176, 177, 178; 24/265 WS, 68 J, 71 J

See application file for complete search history.

(56) References Cited

U.S. PATENT DOCUMENTS

| | | | | |
|---|---|---|---|---|
| 6,023,816 | A * | 2/2000 | Okada | A44C 5/24 24/265 WS |
| 6,098,394 | A * | 8/2000 | Hashimoto | A44C 5/10 59/80 |
| 6,401,307 | B1 * | 6/2002 | Wild | A44C 5/24 24/265 WS |
| 8,001,658 | B2 * | 8/2011 | Christian | A44C 5/246 24/265 WS |
| 9,049,906 | B2 * | 6/2015 | Schmidt | A44C 5/246 |
| 9,282,792 | B2 * | 3/2016 | Mace | A44C 5/24 |
| 2004/0134183 | A1 * | 7/2004 | Mace | A44C 5/107 59/82 |
| 2006/0090305 | A1 * | 5/2006 | Aquillon | A44C 5/2042 24/265 WS |
| 2009/0032672 | A1 * | 2/2009 | Cooper | A63C 5/06 248/544 |

(Continued)

FOREIGN PATENT DOCUMENTS

| | | | | |
|---|---|---|---|---|
| CA | 2362324 | A1 * | 11/2000 | A44C 5/10 |
| CH | 689931 | A5 | 2/2000 | |

(Continued)

OTHER PUBLICATIONS

European Search Report for EP Appl. No. 12188657.6, Mailing Date of May 27, 2013.

*Primary Examiner* — Justin Larson
*Assistant Examiner* — Lester L Vanterpool
(74) *Attorney, Agent, or Firm* — Westerman, Hattori, Daniels & Adrian, LLP

(57) ABSTRACT

An arrangement for the elastic articulated link between two components of a horological assembly, wherein it comprises at least one link shaft and one spring (25; 25') working in torsion mode between the two components to exert an elastic return force.

33 Claims, 25 Drawing Sheets

(56) References Cited

U.S. PATENT DOCUMENTS

| | | | | |
|---|---|---|---|---|
| 2009/0113870 | A1* | 5/2009 | Rejzner ..... | A44C 5/107<br>59/80 |

FOREIGN PATENT DOCUMENTS

| | | | |
|---|---|---|---|
| CH | 699044 | B1 | 1/2010 |
| EP | 0350785 | A1 | 1/1990 |
| EP | 0908112 | A1 | 4/1999 |
| EP | 1203541 | A1 | 5/2002 |
| EP | 1279349 | A1 | 1/2003 |
| EP | 1374716 | A1 | 1/2004 |
| EP | 1654950 | A1 | 5/2006 |

* cited by examiner

I-I

I-I

II-II

ELASTIC ARTICULATION FOR HOROLOGICAL ASSEMBLY

INTRODUCTION

The present invention relates to an arrangement for the elastic articulated link between two components of a horological assembly, notably for a wrist watch bracelet, arranged either at the level of a clasp, or at the level of the link assemblies of this bracelet. It also relates to a clasp, a bracelet and a wrist watch as such comprising such an arrangement.

STATE OF THE ART

FIG. 1 illustrates a solution described in the document EP1654950 for implementing the elastic locking and unlocking of two moving blades 1, 2 of a bracelet clasp. The first moving blade 1 is locked in the folded position on a second blade 2 by the hooking of an attachment lever 3 against an attachment post under the effect of elastic means. In a first embodiment, these elastic means consist of blade springs 5 provided to work by bending, which comprise a free first end 6 bearing on a rod 8 of an intermediate link member and a second end 7 bearing against the internal face of the top wall of the attachment lever.

This design makes it possible to ensure very good locking security, while optimizing the force required to open the clasp, which makes it a very satisfactory solution in terms of security of closure and handling.

The same document describes a second embodiment, represented by FIG. 2, in which the elastic means consist of a helical spring 5' provided to work in compression mode.

Numerous other documents describe other arrangements for the link between two components of a bracelet for a wrist watch, all of which rely on the use of elastic return means based on helical springs working in compression mode.

By way of example, the documents CH689931 and CH699044 both describe a design of clasps for bracelets in which the actuation of a locking mechanism involves the compression of a helical spring extending longitudinally along the bracelet in an opening formed within a blade of the clasp. This design is less efficient than the preceding ones in that the locking force obtained with the use of this type of spring is not optimal and not user-friendly when manipulating such a clasp.

The documents EP1374716 and EP0350785 similarly describe designs of clasps for bracelets in which the actuation of a locking mechanism involves the compression of a helical spring, the latter extending in a direction perpendicular to the longitudinal direction of the bracelet.

The document EP0908112 discloses a locking device for a clasp provided with a cover which is elastically returned by a helical spring working in torsion mode. This spring is arranged around an articulation shaft which coincides with the pivoting axis of the cover. A first end of the spring is bent so as to be inserted with play in a cutout of the cover, whereas a second end of the spring is pressed against a blade of the clasp. It appears that the choice of a spring working in torsion mode makes obtaining a satisfactory elastic effect and a stable articulation movement more complicated because of the assembly plays of such a spring.

Finally, all these existing solutions do not make it possible to achieve an optimal trade-off between the security of the locking or of the elastic articulation, the user-friendliness of its operation, and the bulk of the solution. In practice, the most efficient solutions present the drawback of a significant bulk, which becomes incompatible with certain esthetic aspects sought and limits their uses. Other less bulky solutions are, on the other hand, clearly less efficient.

It will also be noted that the above-mentioned designs have been developed in the context of a clasp for a bracelet but can also be applied to the link between bracelet link assemblies or more generally to all horological components elastically articulated together. For example, this solution can also be applied to the link between a watch case and a bracelet strand.

Thus, one general object of the invention is to propose a solution for an elastic articulated link between two components of a horological assembly, which achieves an optimal trade-off between the efficiency of the elastic assembly and its bulk.

In particular, such a solution is more particularly sought for an application in a bracelet clasp, or for the articulation of blades or link assemblies of a wrist watch bracelet.

BRIEF DESCRIPTION OF THE INVENTION

To this end, the invention relies on an arrangement for the elastic articulated link between two components of a horological assembly, wherein it comprises at least one spring working in torsion mode to generate the elastic effect of the articulation.

The invention is more specifically defined by the claims.

BRIEF DESCRIPTION OF THE FIGURES

These objects, features and advantages of the present invention will be explained in detail in the following description of particular embodiments, given in a nonlimiting manner in relation to the appended figures in which:

FIGS. 6*a* to 8*a* represent cross-sectional views respectively in longitudinal planes I-I, II-II, III-III of the clasp according to the first embodiment of the present invention.

FIGS. 6*b* to 8*b* represent enlarged views according to the preceding cross-sectional views.

FIGS. 13*a* to 15*a* represent cross-sectional views respectively in longitudinal planes I-I, II-II, III-III of the clasp according to the second embodiment of the present invention.

FIGS. 13*b* to 15*b* represent enlarged views of the clasp according to the preceding cross-sectional views.

FIGS. 20*a* to 22*a* represent cross-sectional views respectively in longitudinal planes I-I, II-II, III-III of the clasp according to the third embodiment of the present invention.

FIGS. 20*b* to 22*b* represent enlarged views of the clasp according to the preceding cross-sectional views.

FIGS. 29*a* to 31*a* represent cross-sectional views respectively in longitudinal planes I-I, II-II, III-III of the clasp according to the fourth embodiment of the present invention.

FIGS. 29*b* to 31*b* represent enlarged views of the clasp according to the preceding cross-sectional views.

FIGS. 36*a* to 38*a* represent cross-sectional views respectively in longitudinal planes I-I, II-II, III-III of the clasp according to the fifth embodiment of the present invention.

FIGS. 36*b* to 38*b* represent enlarged views of the clasp according to the preceding cross-sectional views.

Figure 1:
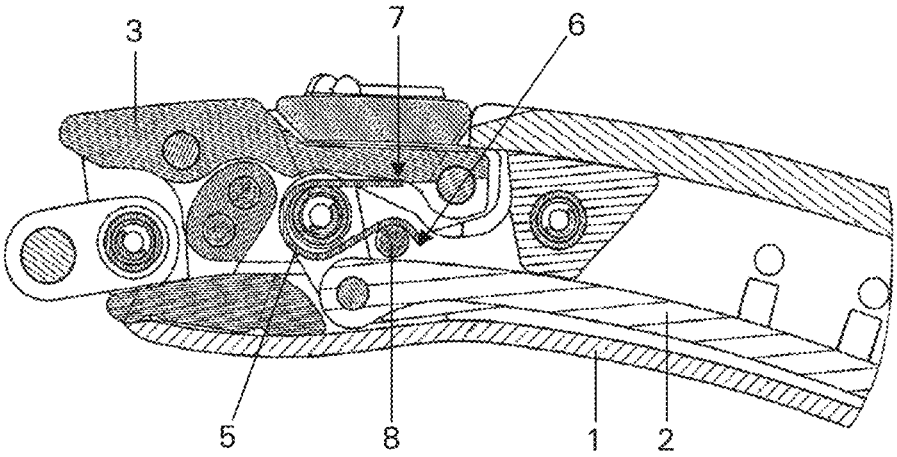
FIG. 1 represents a cross-sectional view of a clasp according to a first solution of the prior art.
Figure 2:
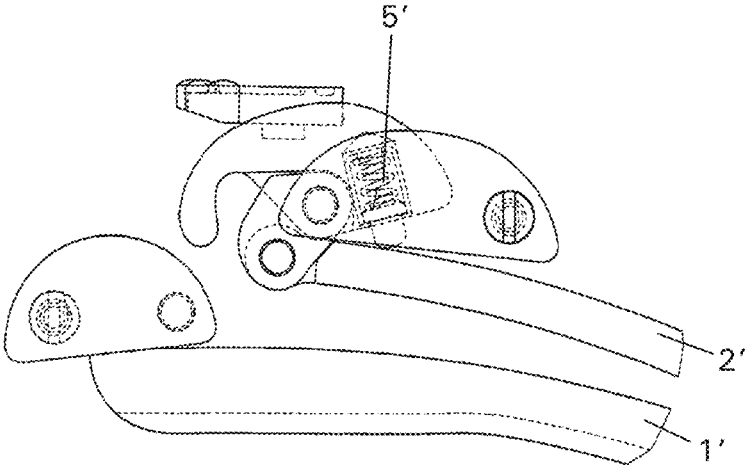
FIG. 2 represents a cross-sectional view of a clasp according to the second solution of the prior art.
Figure 3:
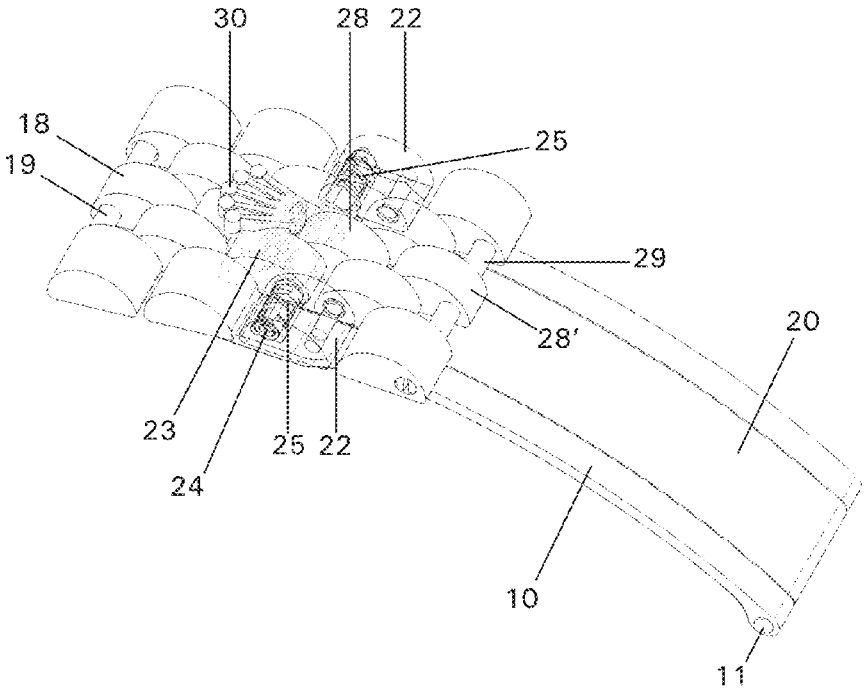
FIG. 3 represents a plan perspective view of a clasp according to a first embodiment of the invention.
Figure 4:
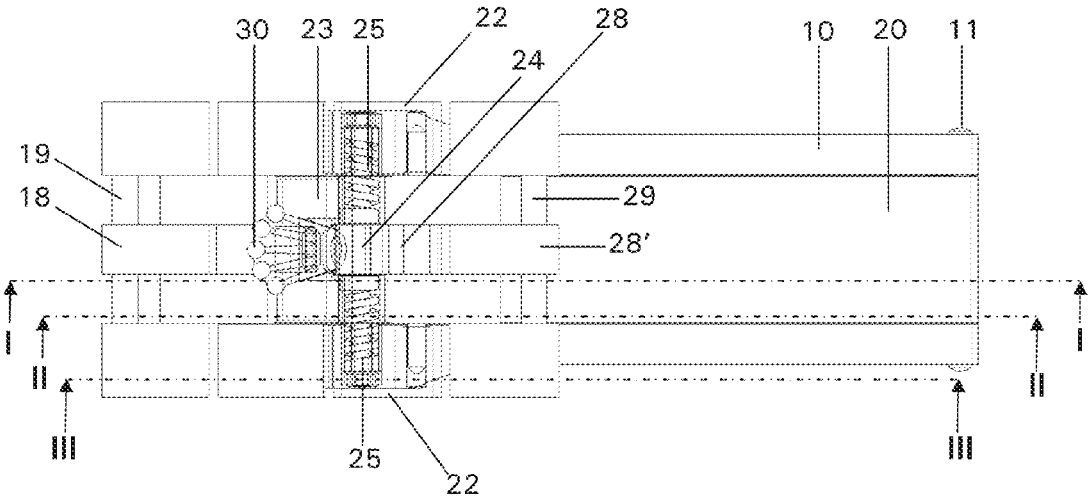
FIG. 4 represents a plan view of the clasp according to the first embodiment in which the significant elements of the solution are shown by transparency, in particular the torsion springs.

The invention therefore relies on the use of at least one spring working in torsion mode. As will be illustrated hereinbelow, the use of such a solution makes it possible to greatly reduce the bulk of the solution.

Hereinafter in the description, the same references will be used to designate equivalent elements on the different embodiments of the invention to make it easier to understand them.

FIGS. 3 to 8 illustrate a clasp for a bracelet according to a first embodiment of the invention. This clasp comprises two blades 10, 20 articulated according to a principle similar to that described in the document EP1654950 which will not be detailed again at this stage. The latter implements two torsion springs 25, notably two helical springs, arranged around the articulation shaft 24 of the attachment lever 23. The invention is thus implemented on the articulation of a locking/unlocking element of a clasp for a bracelet.

Thus, the clasp according to this first embodiment comprises a first blade 10 bearing an attachment post 13 toward a first end bearing a first bracelet link assembly consisting of a number of links 18 linked in an articulated manner by shafts 19. These elements are more particularly visible in FIGS. 6 to 8. This first link assembly constitutes one end of a first bracelet strand. This first blade 10 is linked in an articulated manner to a second blade 20 around an articulation shaft 11 at its second end.

This second blade 20 bears, toward its free end opposite to the articulation shaft 11, an attachment lever 23 which comprises a hook cooperating with the attachment post 13. The attachment lever 23 is articulated around an articulation shaft 24 which extends over substantially all the width of the clasp, in a direction perpendicular to its longitudinal direction. Two torsion springs 25 are arranged around this articulation shaft 24, as will be detailed hereinbelow. A bracelet link assembly is also arranged at this same end of the second blade 20, and constitutes one end of the second bracelet strand. This link assembly comprises a central link 28 and two edge links 22 linked to the articulation shaft 24 of the attachment lever 23. This first row of links is linked to other links 28'. All these links of the link assembly are linked by shafts 29. Finally, a gripping member 30 is securely attached to the attachment lever 23 to make it easier to manipulate. As can particularly be seen in FIG. 3, in the closed position of the clasp, the different links 18, 22, 28, 28' of the two blades 10, 20 form a continuous assembly, within which the gripping member 30 is incorporated discretely but in an easily manipulable way, between the links of the clasp, to ensure an attractive appearance. The attachment lever 23 is in a form similar to that of a bracelet link. The bracelet thus has a continuous appearance all around the wrist in the closed configuration of the clasp, which is ultimately very difficult to see, notably by virtue of its small thickness because of the reduced bulk of its mechanism, explained hereinbelow.

Figure 5:
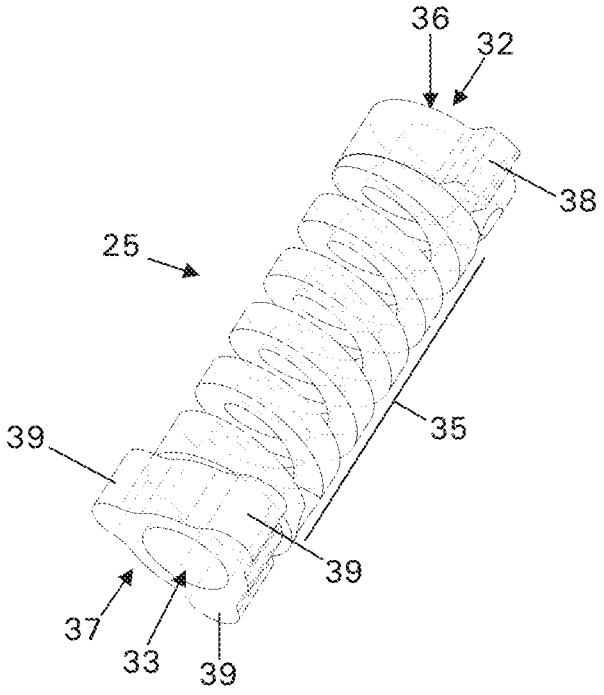
FIG. 5 represents a perspective view of a spring used in the first embodiment of the invention.

FIG. 5 represents a perspective view of a spring 25 used in this first embodiment. Such a spring 25 comprises a helical central part 35 consisting of turns, fulfilling the elastic function of the spring, and arranged between two ends 36, 37. Each of these ends 36, 37 comprises a substantially cylindrical shape, the circumference of which comprises at least one protuberance, respectively 38, 39. Furthermore, circular cutouts 32, 33 are made at the center of respectively each of the two ends 36, 37, and extend in the direction of the axis of the spring. In this embodiment, the clasp uses two springs as described above, which are symmetrical relative to the longitudinal plane of the clasp and aligned.

The operation of the solution according to this first embodiment will be better illustrated by the cross-sectional views of FIGS. 6 to 8.

Figure 6A:
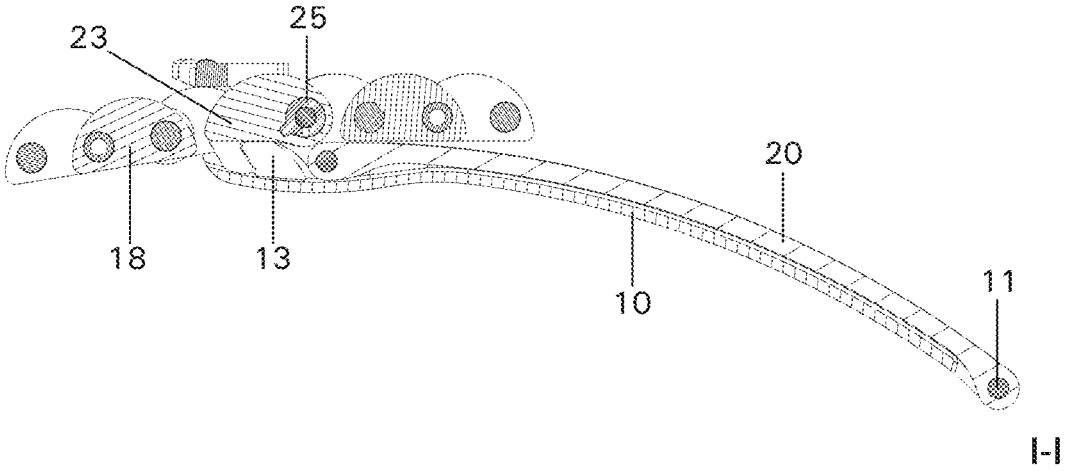
Figure 6B:
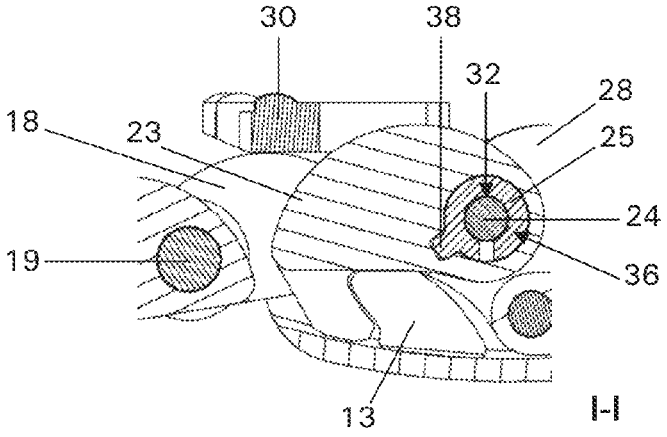

FIGS. 6*a* and 6*b* thus illustrate a cross section of the clasp according to the first embodiment in a longitudinal plane I-I at the first end 36 of a spring 25. It can be seen that this end 36 is arranged in such a way that its protuberance 38 is housed in an opening formed within the attachment lever 23, this opening forming a key form for the protuberance 38. This architecture makes it possible to block the rotation, that is to say in both directions of rotation, of the end 36 of the spring 25 relative to the attachment lever 23. It should be noted that this key form can have an ideal shape which truly immobilizes the protuberance and therefore the end of the spring or, as a variant, can be only roughly complementary, leaving a radial play at the level of the link of the protuberance and of its key form, or even leave an angular travel of the protuberance between two abutments defined by the key form. The internal cutout 32 is positioned with less play around the articulation shaft 24.

Figure 7A:
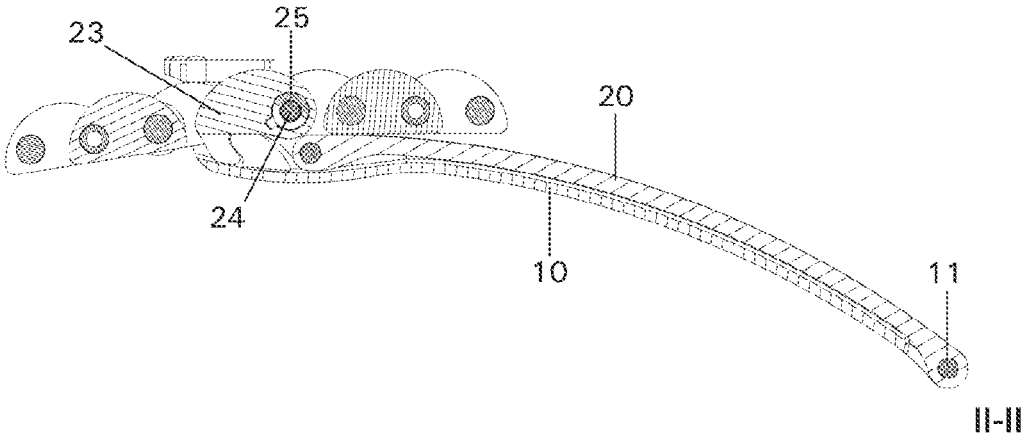
Figure 7B:
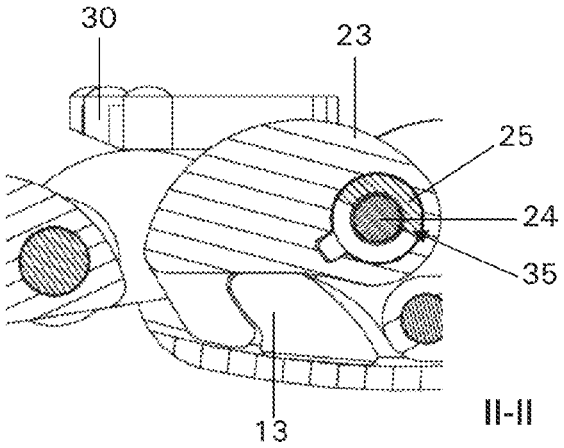

FIGS. 7*a* and 7*b* illustrate this same clasp in the central part of the spring 25. Thus, there is a portion of turn of the central part 35 of the spring 25 which surrounds, with play, the articulation shaft 24.

Figure 8A:
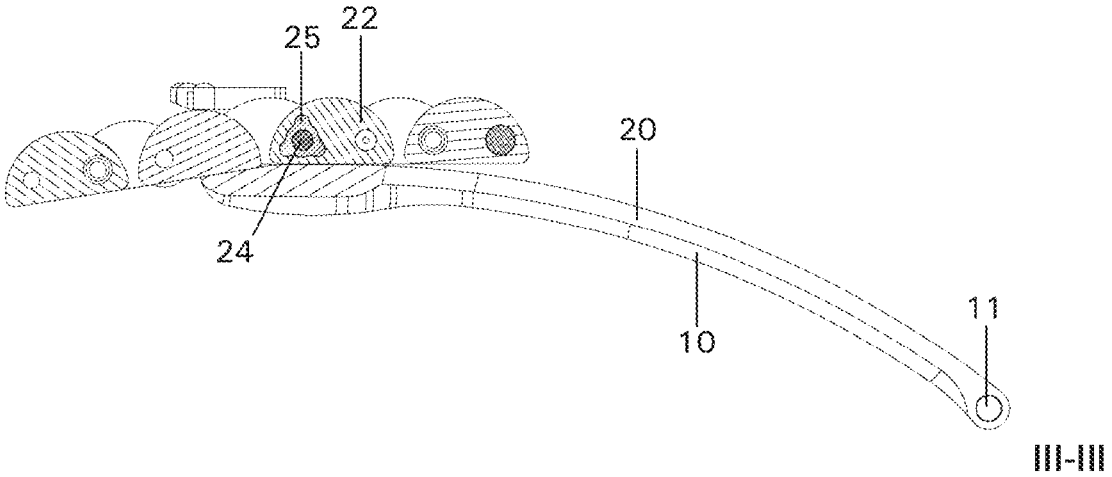
Figure 8B:
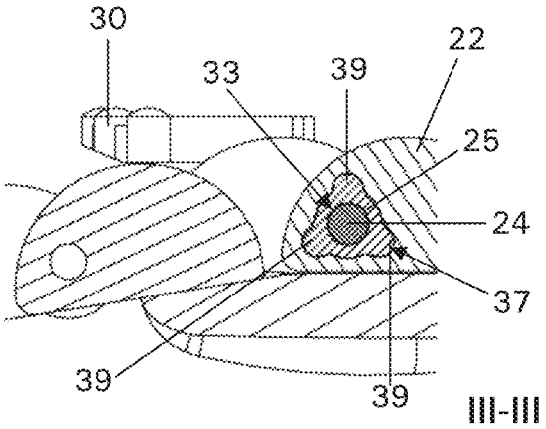

Finally, FIGS. 8*a* and 8*b* illustrate a cross section of the clasp according to the first embodiment in a longitudinal plane at the second end 37 of a spring 25. Its protuberances 39 cooperate with corresponding openings which are roughly complementary, even complementary, to them, and which are arranged in the internal surface of an edge link 22 of the clasp, which makes it possible to block the rotation of this second end. The latter can be driven, welded, or brazed onto the edge link 22 to improve its fixing, or even fixed by any other means such as gluing. As a variant, it is not fixed but blocked with play, even limited radial (angular) travel. The internal cutout 33 is positioned with less play around the articulation shaft 24.

The internal diameter obtained by at least one lateral cutout 32, 33 is less than the internal diameter of the turns of the central part 35 of the spring 25. Furthermore, the external diameter (excluding the protuberances 38, 39) of the ends 36, 37 (or of at least one end) of the spring 25 is greater than the external diameter of the turns of the central part 35 of the spring. Preferentially, the protuberances are in the extension of the external diameter of the ends 36, 37. By this construction, the guiding of the rotation of the attachment lever 23 is ensured by the ends 36, 37 of the spring, in contact with its internal cutout with the articulation shaft 24 and in its external part with, on the one hand, the attachment lever 23 and, on the other hand, an edge link 22. This guiding thus becomes independent of the geometrical fluctuations of the turns of its central part. The ends of the spring therefore form surfaces for guiding the relative movement of the two horological components, which stabilizes this movement and in particular its elastic return.

Other embodiments of clasps will now be described, implementing other types of clasp locking/unlocking mechanisms, with other elastic torsion means. Since the invention does not relate to the clasp locking/unlocking device as such, the latter will be described briefly hereinbelow.

FIGS. 9 to 15 illustrate a clasp according to a second embodiment of the invention.

Figure 9:
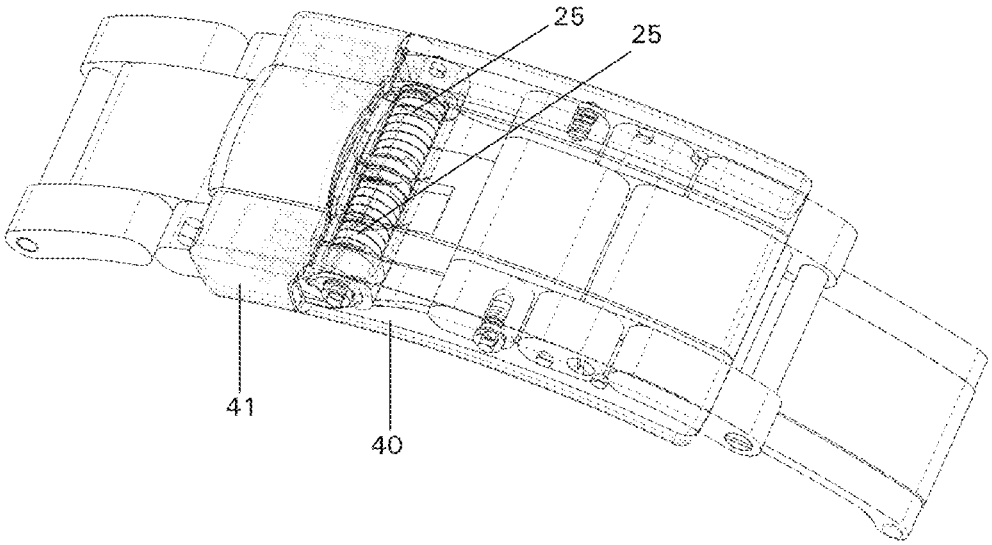
FIG. 9 represents a plan perspective view of a clasp according to a second embodiment of the invention.
Figure 10:
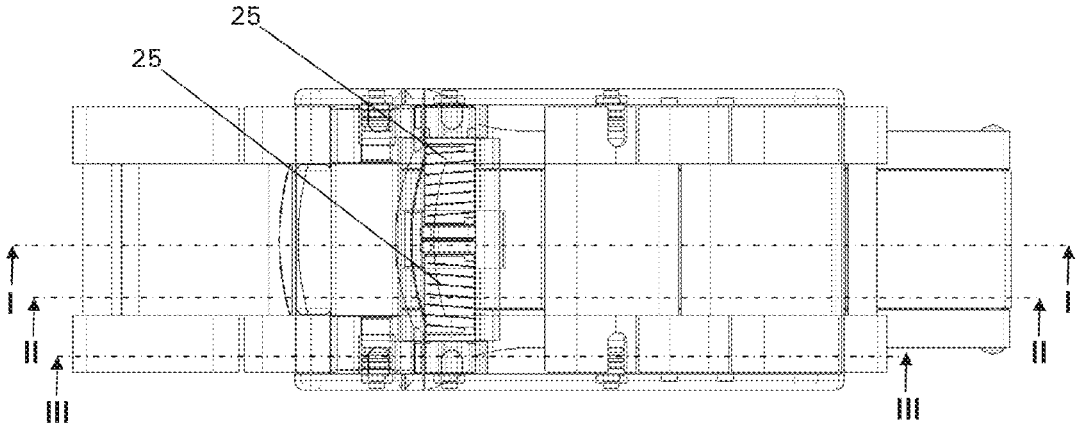
FIG. 10 represents a plan view of the clasp according to the second embodiment in which the significant elements of the solution are shown by transparency, in particular the torsion springs.

This clasp, notably illustrated by FIGS. 9 and 10, similarly comprises two articulated blades, but, unlike the preceding embodiment, is provided with a cover which covers the mechanism in the closed position of the clasp. This cover comprises a first part in the form of a moving tab 41, which can be pivoted by its two lateral ends, which is securely attached to an attachment lever 23 which fulfills the function of the attachment lever of the preceding embodiment, and a fixed second part 40.

Figure 11:
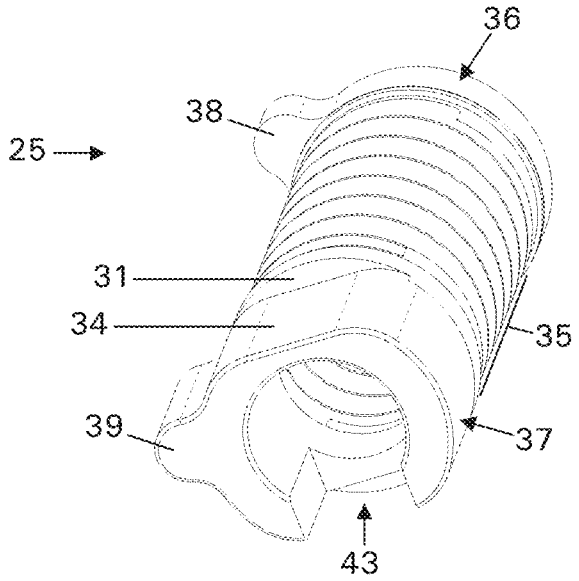
FIG. 11 represents a perspective view of a spring used in the second embodiment of the invention.
Figure 12:
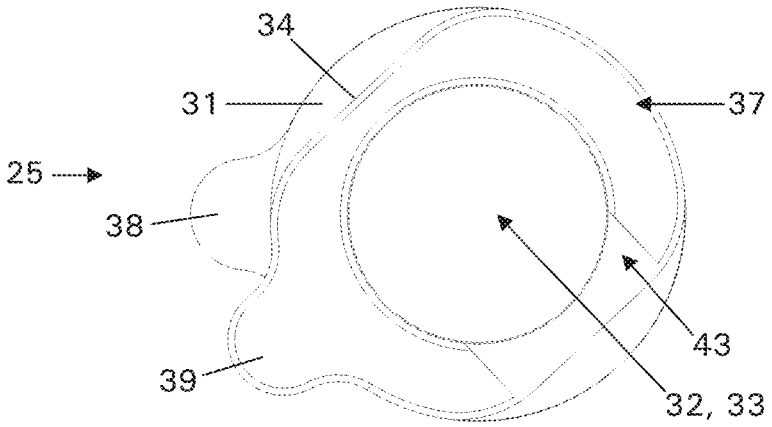
FIG. 12 represents a side view of the spring used in the second embodiment of the invention.

In this embodiment, a different spring 25, represented by FIGS. 11 and 12, is used. It still comprises a central part 35, comprising turns, to fulfill the elastic function, between two ends 36, 37. However, these two ends have a slightly different shape which will be explained with reference to the following figures.

Figure 13A:
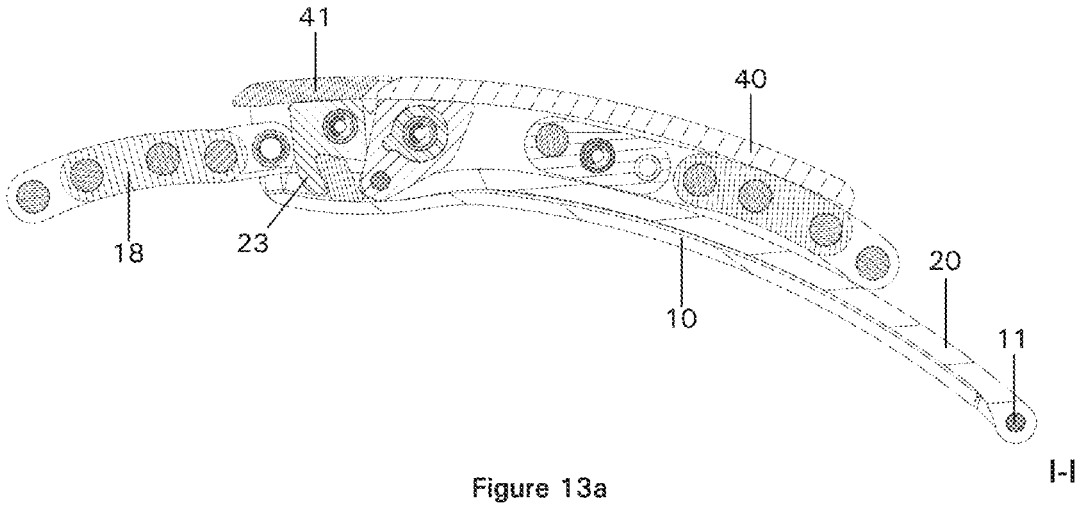
Figure 13B:
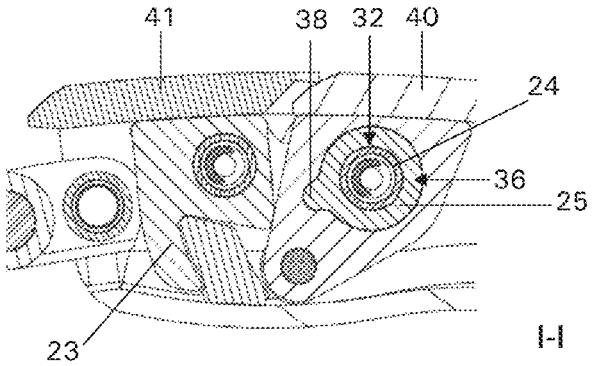

FIGS. 13*a* and 13*b* thus illustrate a cross section of the clasp in a longitudinal plane I-I at the first end 36 of a spring 25. It can be seen that this end 36 is arranged in such a way that the protuberance 38 is housed within an opening formed within a part securely attached to the fixed second part 40 of the cover, forming a key form for the protuberance 38. This architecture makes it possible to block the rotation of the end 36 of the spring 25 relative to the cover.

Figure 14A:
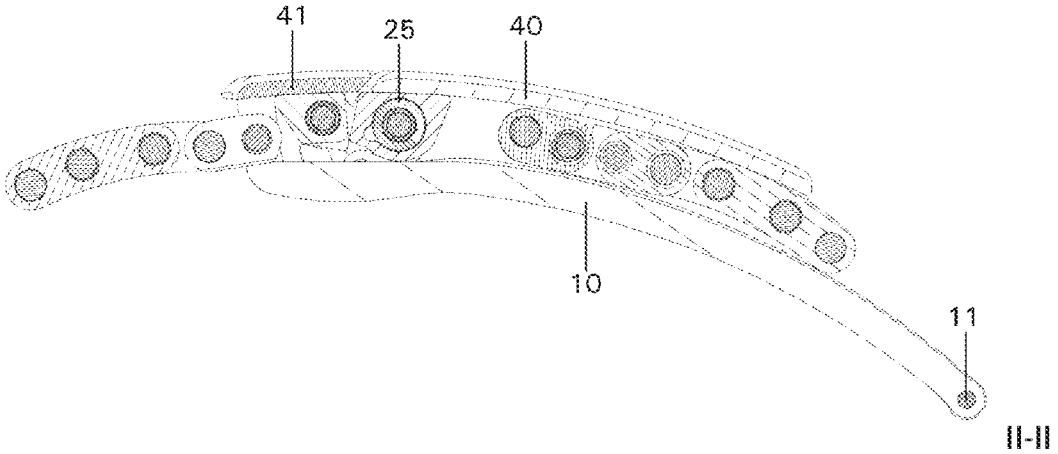
Figure 14B:
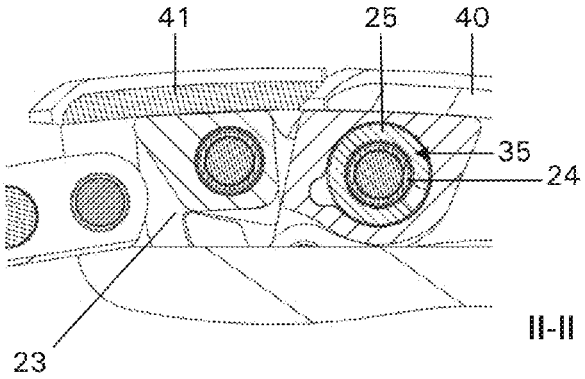

FIGS. 14*a* and 14*b* illustrate this same clasp by a cross section II-II in the central part of the spring 25. There is thus a portion of turn of the spring 25 which surrounds a bar, notably a spring bar or removable bar, forming an articulation shaft 24.

Figure 15A:
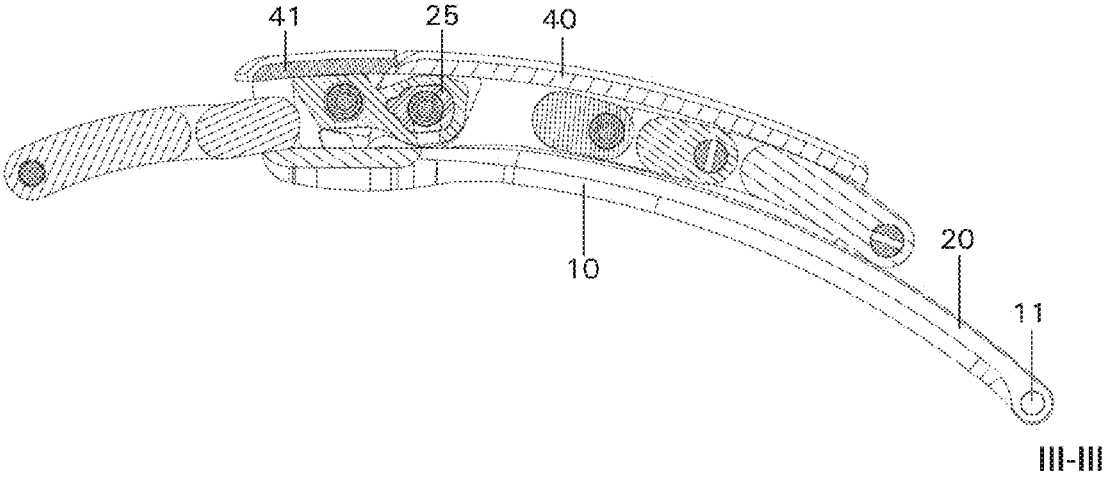
Figure 15B:
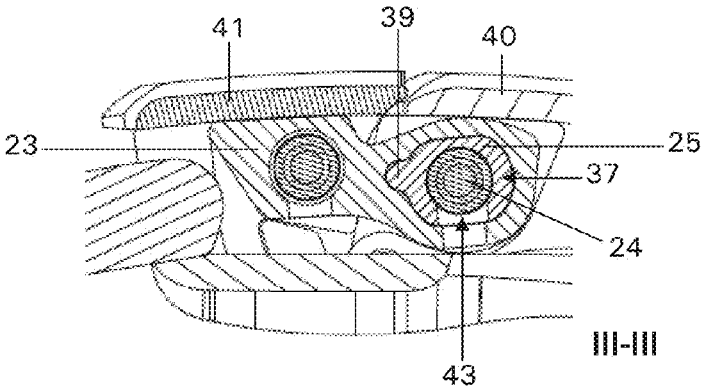

Finally, FIGS. 15*a* and 15*b* illustrate a cross section III-III of the clasp at the second end 37 of a spring 35. Its protuberance 39 cooperates with corresponding openings arranged in the internal surface of the moving tab 41, which makes it possible to block the rotation of this second end relative to the moving tab. This second end also comprises a flat 34 on its circumference, to cooperate with a countersink of a link assembly securely attached to the cover. This flat also makes it possible to form an abutment 31 which delimits the lateral shake of the spring 25. Finally, this second end 37 of the spring 25 also comprises a radial through cutout 43, complementary to a cutout made in the moving tab 41 of the cover, to enable the cover to be mounted/removed in a conventional manner by allowing free access to the ends of the bar (articulation shaft 24).

As in the preceding embodiment, the diameter of at least one lateral cutout 32, 33 of an end 36, 37 of the spring 25 is less than the internal diameter of the turns of the central part 35 of the spring 25 so that the spring 25 can pivot with less play on the articulation shaft 24. Furthermore, the external diameter (excluding the protuberances 38, 39) of the ends 36, 37 (or of at least one end) of the spring 25 is greater than the external diameter of the turns of the central part 35 of the spring. By this construction, the guiding of the rotation of the attachment lever and of the moving tab is ensured by the ends of the spring, independently of the geometrical fluctuations of the turns of its central part.

FIGS. 16 to 23 illustrate a clasp according to a third embodiment of the invention.

Figure 16:
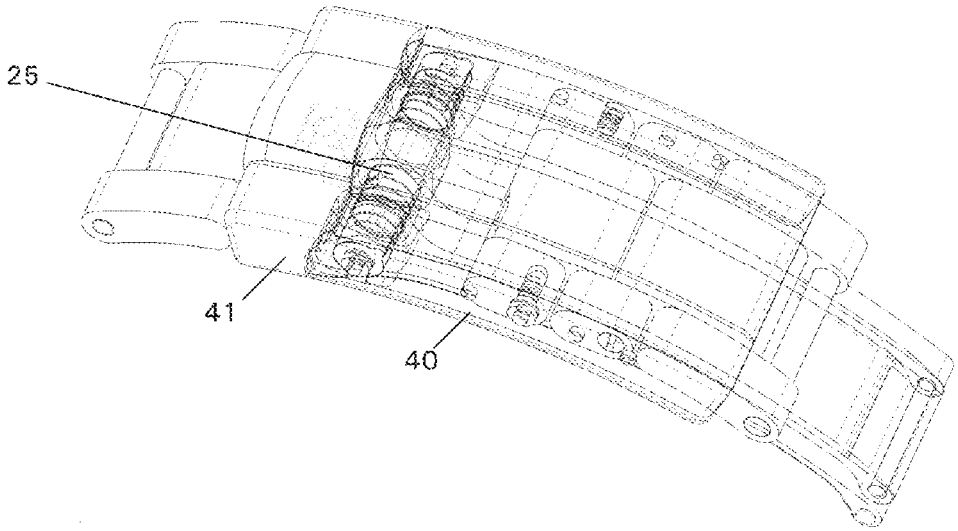
FIG. 16 represents a plan perspective view of a clasp according to a third embodiment of the invention.
Figure 17:
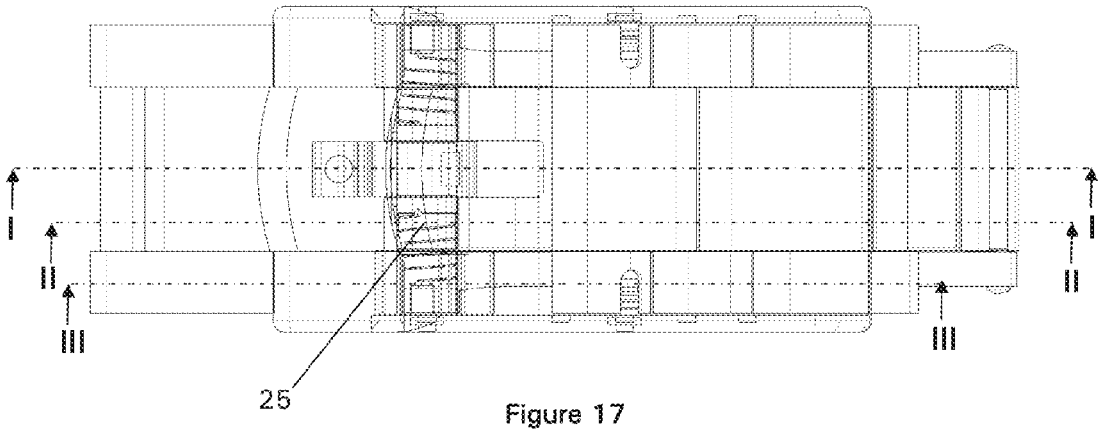
FIG. 17 represents a plan view of the clasp according to the third embodiment in which the significant elements of the solution are shown by transparency, in particular the torsion spring.

This clasp, notably illustrated by FIGS. 16 and 17, is very similar to the preceding design. It differs in that the attachment lever 23, securely attached to the moving tab 41 of the cover, can pivot in its central part via a central link forming a component securely attached to the attachment lever of the first embodiment.

Figure 18:
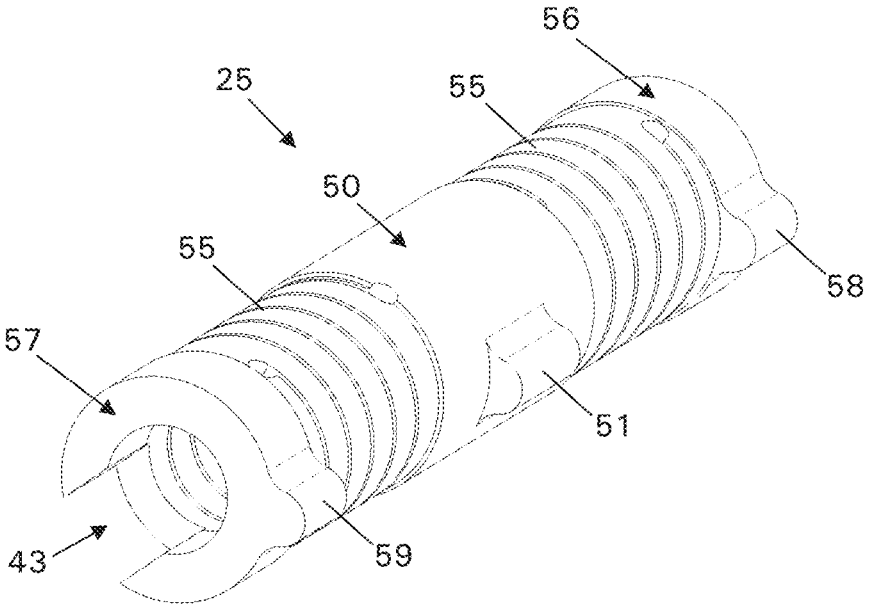
FIG. 18 represents a perspective view of a spring used in the third embodiment of the invention.
Figure 19:
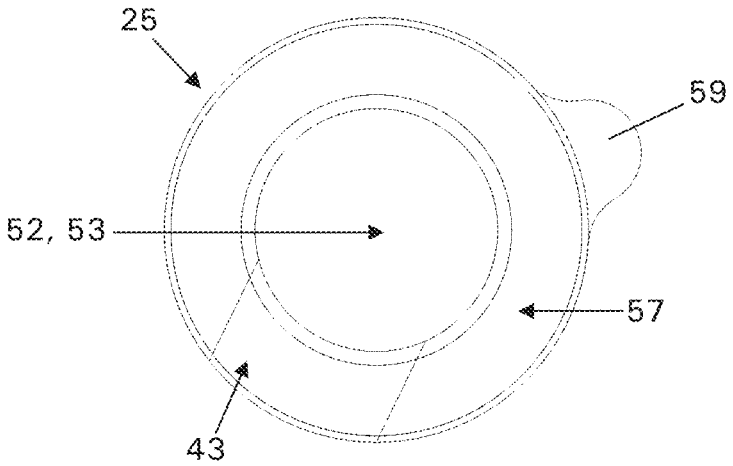
FIG. 19 represents a side view of the spring used in the third embodiment of the invention.

In this design, a single spring 25 is used, represented by FIGS. 18 and 19. This spring comprises two so-called "spring" elastic areas 55 consisting of turns, arranged respectively between a central part 50 and each of the two ends 56, 57 of the spring. Each end can comprise shapes similar to the design described previously and notably comprise at least one protuberance 58, 59. The central part 50 comprises a cylindrical shape also comprising at least one protuberance 51. Furthermore, through cutouts 52, 53 are also provided at the two ends 56, 57 and in the central part 50 of the spring. Other aspects of this spring are detailed hereinbelow.

Figure 20A:
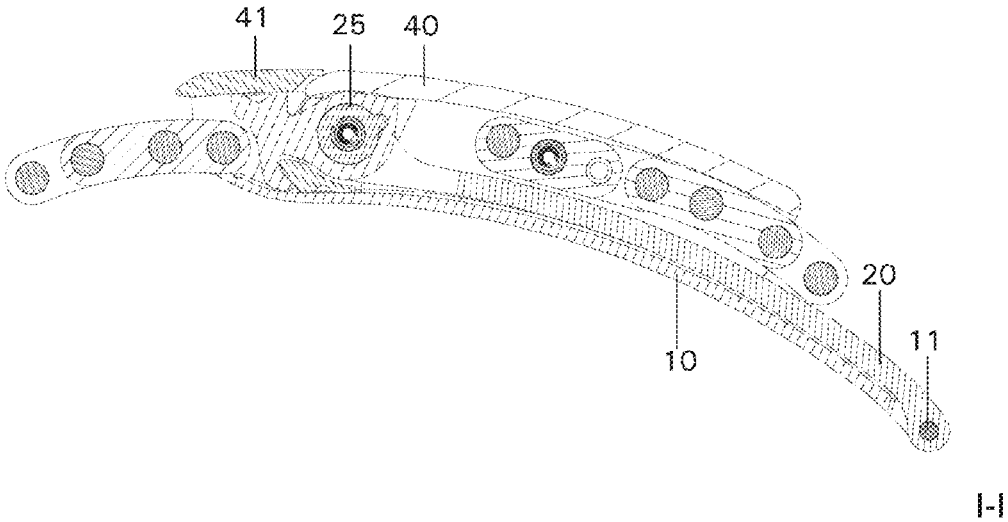
Figure 20B:
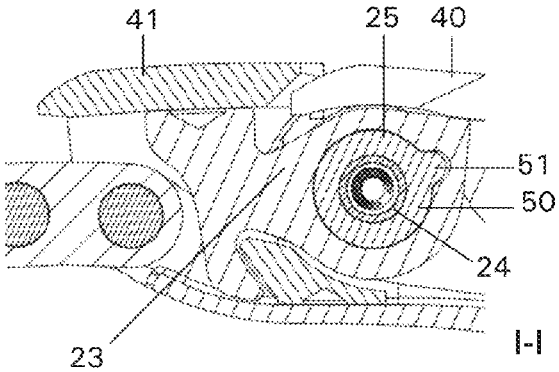

FIGS. 20*a* and 20*b* thus illustrate a cross section of the clasp in a longitudinal plane I-I in the central part 50 of the spring. It can be seen that the protuberance 51 is housed within an opening formed within the moving link assembly which is linked to the attachment lever 23 and to the moving tab 41 of the cover, this cover forming a key form of the protuberance. This architecture makes it possible to block the rotation of the central part 50 of the spring 25 relative to this moving tab 41.

Figure 21A:
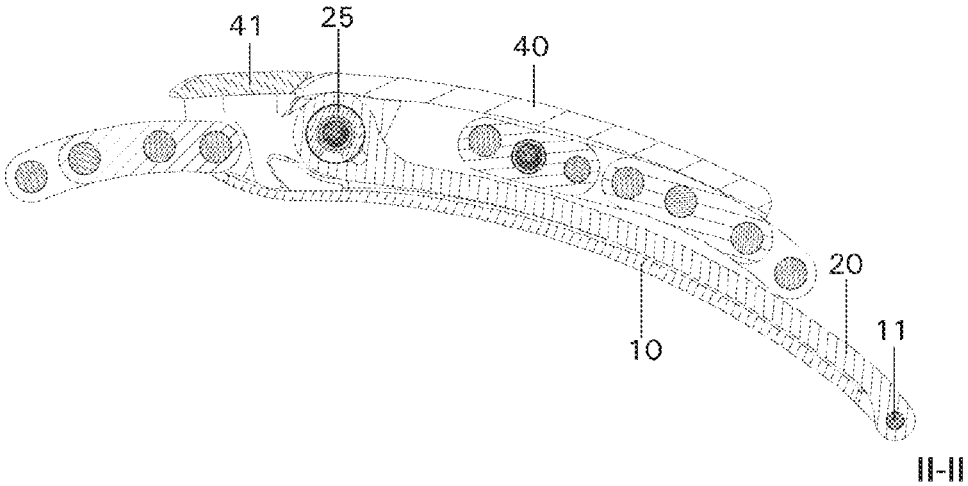
Figure 21B:
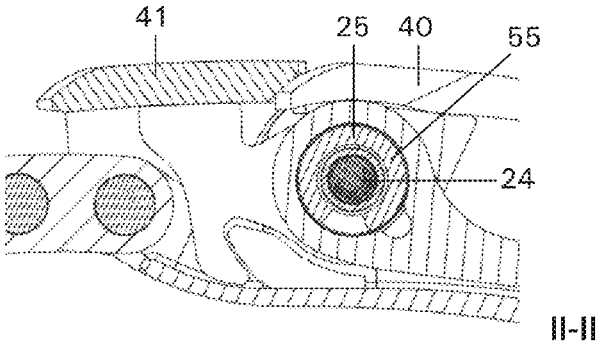

FIGS. 21*a* and 21*b* illustrate this same clasp by a cross section in an intermediate spring area 55 of the spring 25. There is thus a portion of turn of the spring 25 which surrounds, with play, a bar forming an articulation shaft 24.

Figure 22A:
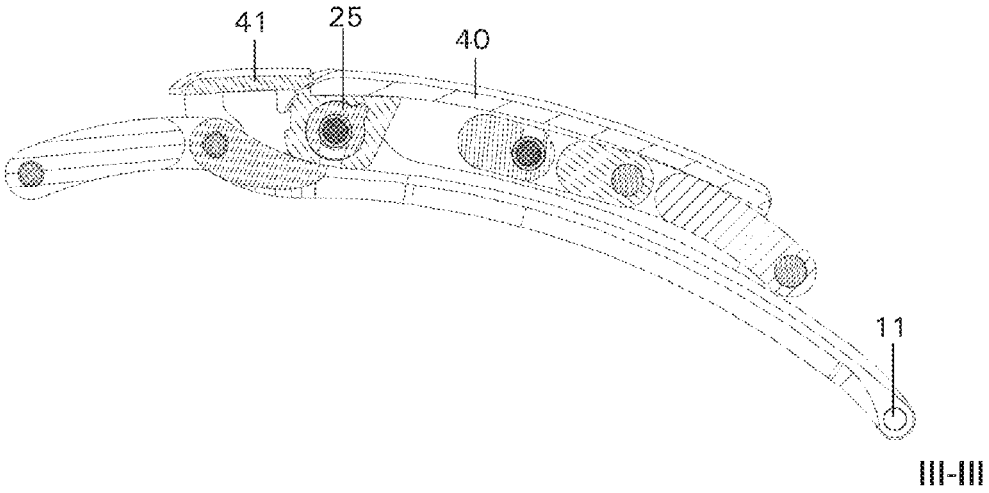
Figure 22B:
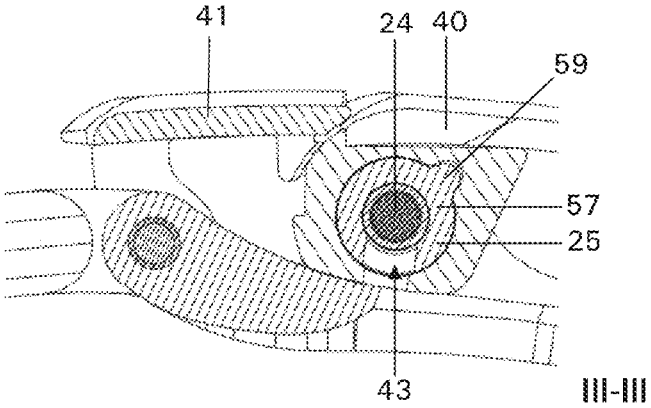

Finally, FIGS. 22*a* and 22*b* illustrate a cross section of the clasp at an end 57 of the spring 25. It should be noted that the architecture of this solution is symmetrical about a median plane and it would be possible here to consider identically either of the two lateral parts of the clasp. The protuberance 59 cooperates with corresponding openings arranged in edge parts securely attached to the fixed part 40 of the cover, which makes it possible to block the rotation of the two ends of the spring 25.

Figure 23:
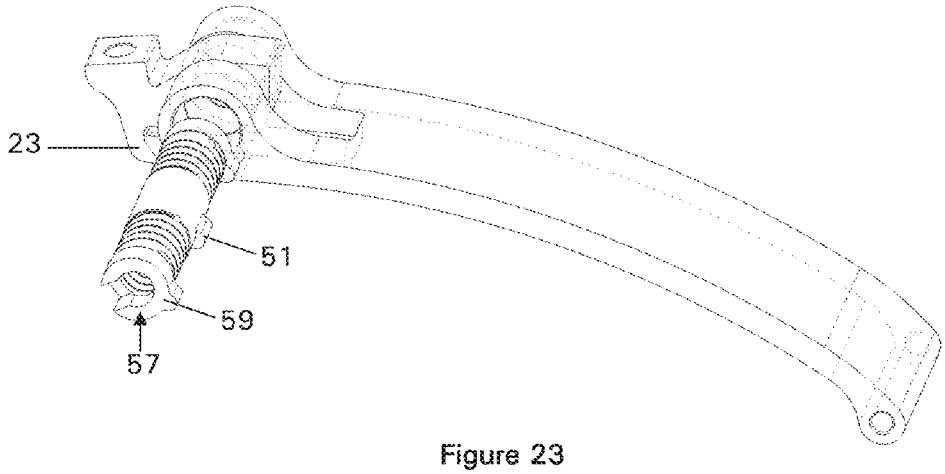
FIG. 23 represents a schematic view of the mounting of a spring in a clasp according to the third embodiment of the present invention.

It should be noted that the fitting of this clasp requires fitting and removing the articulation shaft 24 and the spring 25. For this, the protuberances 58, 59 arranged at the ends 56, 57 of the spring 25 make it possible to pass through the opening of the moving link assembly which is securely attached to the attachment lever 23, which receives the protuberance 51 of the central part of the spring 25, as illustrated by FIG. 23. The protuberances 58, 59, 51 are, for example, aligned in this embodiment. Furthermore, the through cutouts 43 make it possible to fit and remove the clasp cover, as in the preceding embodiment.

The diameter of the circular cutout of the central part 50 of the spring 25 is less than the internal diameter of the turns of the two spring areas 55, and less than or equal to the diameter of the circular cutouts 52, 53 of the ends 56, 57 of the spring 25. Furthermore, this internal diameter of the central part 50 of the spring 25 pivots with less play on the articulation shaft 24. In a complementary manner, the external diameter (excluding the protuberances 51, 58, 59) of the central part 50 of the spring 25, even walls of the ends 56, 57 (or of at least one end) of the spring 25, is greater than the external diameter of the turns of the spring areas 55 of the spring. By this construction, the guiding of the rotation of the attachment lever and of the moving tab of the cover is ensured independently of the geometrical fluctuations of the turns of its spring areas.

FIGS. 24 to 31 illustrate a clasp according to a fifth embodiment of the invention.

Figure 24:
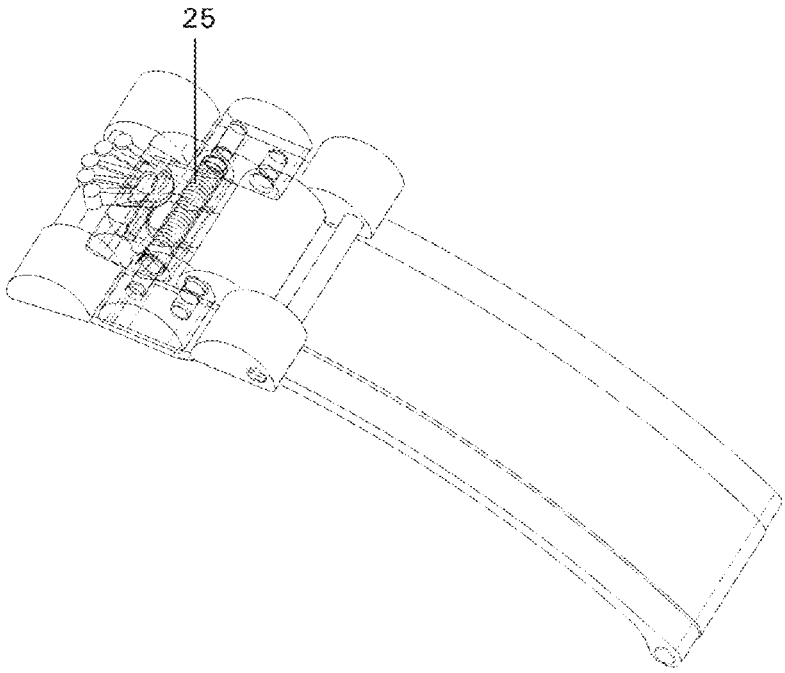
FIG. 24 represents a plan perspective view of a clasp according to a fourth embodiment of the invention.
Figure 25:
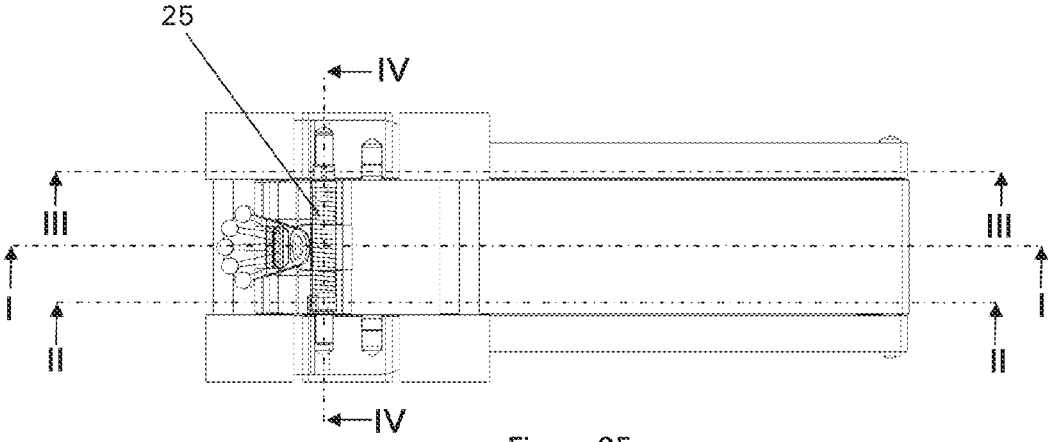
FIG. 25 represents a plan view of the clasp according to the fourth embodiment in which the significant elements of the solution are shown by transparency, in particular the torsion spring.
Figure 26:
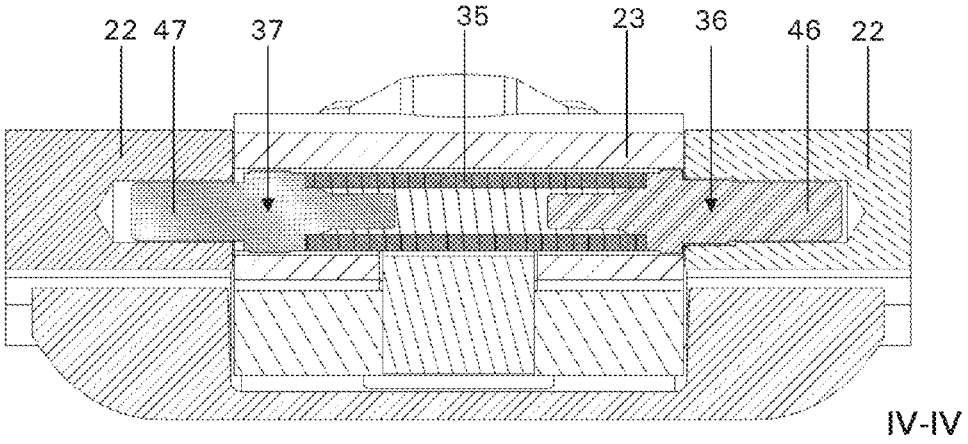
FIG. 26 represents a cross-sectional view in a transversal plane IV-IV comprising the torsion spring of the fourth embodiment of the invention.

This clasp differs from the preceding designs in that the torsion spring is not associated with a distinct articulation shaft, but on its own fulfills the additional function of an articulation shaft. FIGS. 24 to 26 illustrate this fourth embodiment in the case of a clasp without cover, similar to the design according to the first embodiment.

Figure 27:
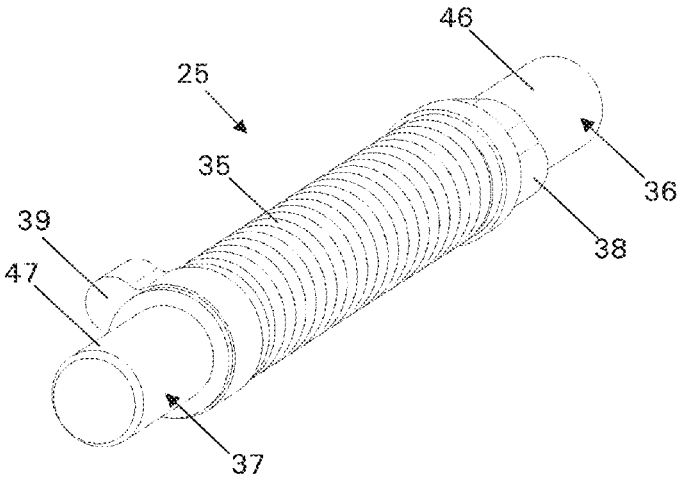
FIGS. 27 and 28 represent perspective views of a spring used in the fourth embodiment of the invention.
Figure 28:
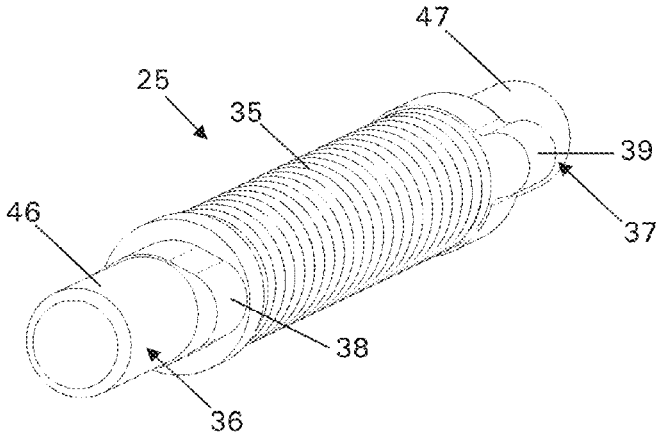

In this design, a single spring 25 is used, represented by FIGS. 27 and 28. This spring 25 comprises a helical central part 35 consisting of turns, arranged between two ends 36, 37. Each of these ends comprises a substantially cylindrical shape, the circumference of which comprises at least one protuberance, respectively 38, 39. Each end also comprises elongate cylindrical portions 46, 47 which fulfill the radial guiding function. Other aspects of this spring are detailed hereinbelow.

Figure 29A:
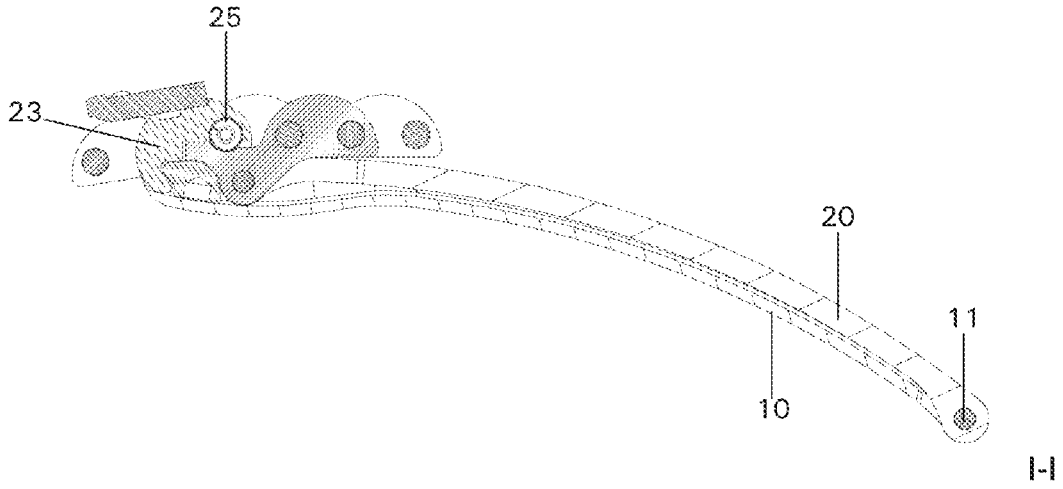
Figure 29B:
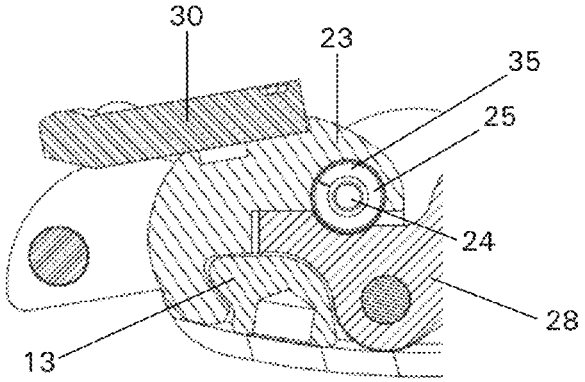
Figure 30A:
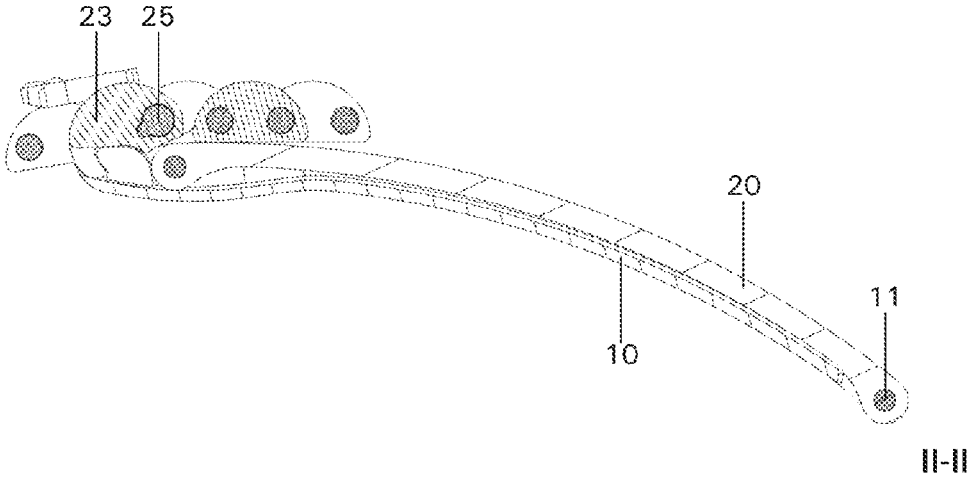
Figure 30B:
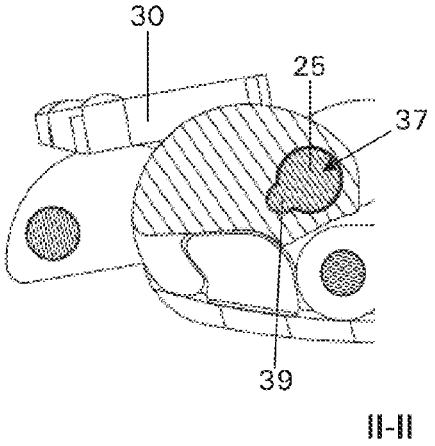

FIGS. 29*a* and 29*b* thus illustrate a cross-sectional view of the clasp in a longitudinal plane I-I in the central part of the spring 25. There is thus a portion of turn of the spring 25 around which the attachment lever 23 of the clasp pivots.

Figure 31A:
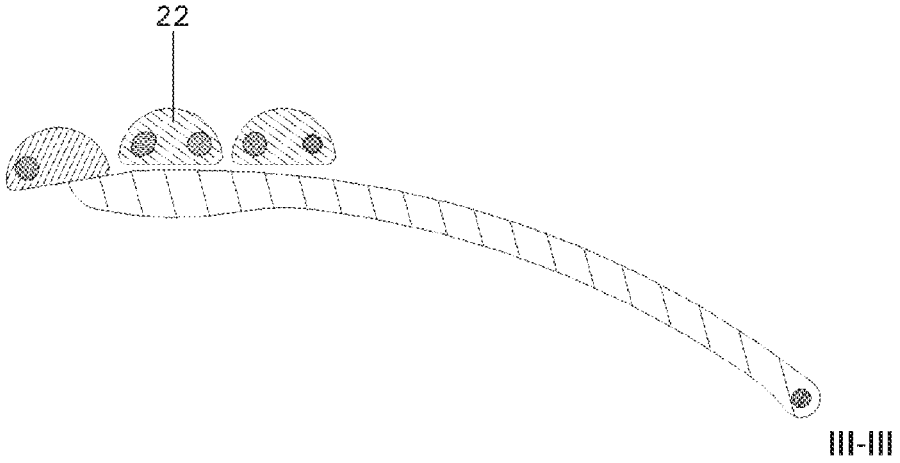
Figure 31B:
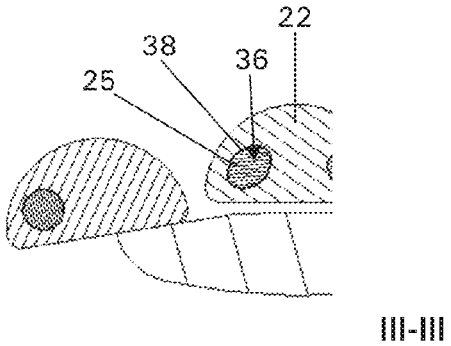

FIGS. 31*a* and 31*b* show a cross-sectional view of the clasp in a longitudinal plane II-II according to the fourth embodiment at a first end 37 of the spring 25. The protuberance 39 of the spring 25 cooperates with a corresponding opening arranged in the attachment lever 23, which makes it possible to block the rotation of this end of the spring 25.

FIGS. 31*a* and 31*b* show a cross-sectional view of the clasp in a longitudinal plane III-III according to the fifth embodiment at the second end 36 of the spring 25. The protuberance 38 of the spring cooperates with a corresponding opening arranged in an edge link 22, which makes it possible to block the rotation of this end of the spring 25.

As in the preceding designs, the spring 25 comprises external surfaces of greater diameter at at least one of its ends, which makes it possible to form guiding surfaces for the pivoting movement, and render the movement independent of the rest of the fluctuations of the spring.

FIGS. 32 to 38 illustrate a clasp according to a fifth embodiment of the invention.

Figure 32:
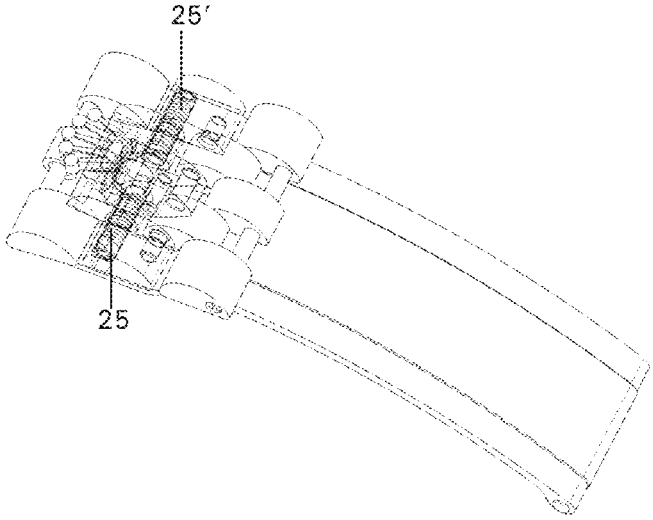
FIG. 32 represents a plan perspective view of a clasp according to a fifth embodiment of the invention.
Figure 33:
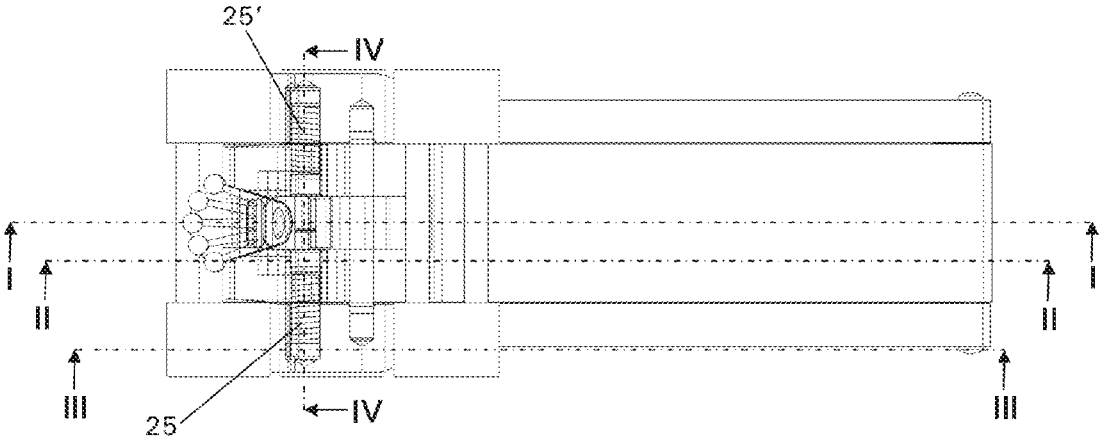
FIG. 33 represents a plan view of the clasp according to the fifth embodiment in which the significant elements of the solution are shown by transparency, in particular the torsion springs.
Figure 34:
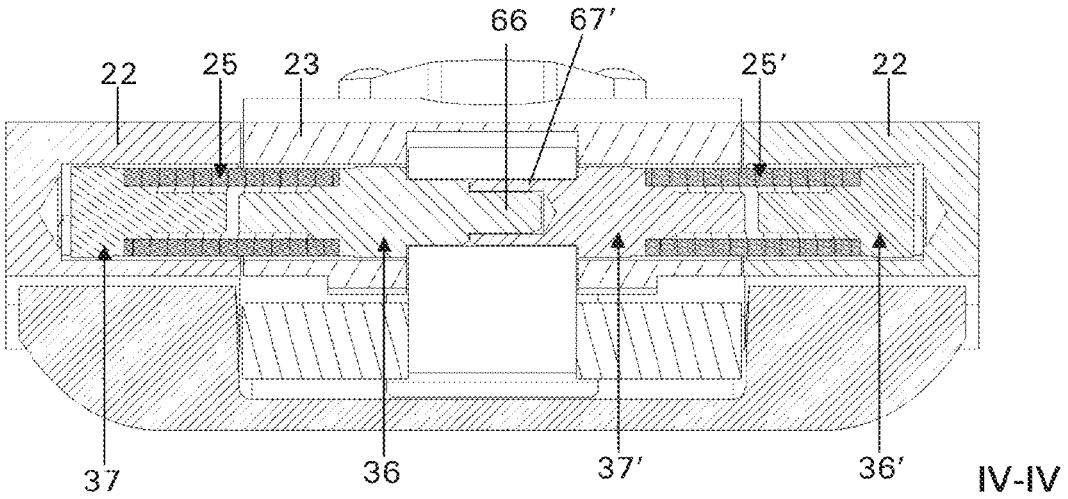
FIG. 34 represents a cross-sectional view in a transversal plane IV-IV comprising the torsion sprigs of the fifth embodiment of the invention.

This clasp differs from the preceding design in that it uses two torsion springs, which remain unassociated with a distinct articulation shaft, but on their own fulfill the additional function of articulation shaft. FIGS. 32 to 34 illustrate this fifth embodiment in the case of a clasp without cover, similar to the design according to the first embodiment and the preceding design.

Figure 35:
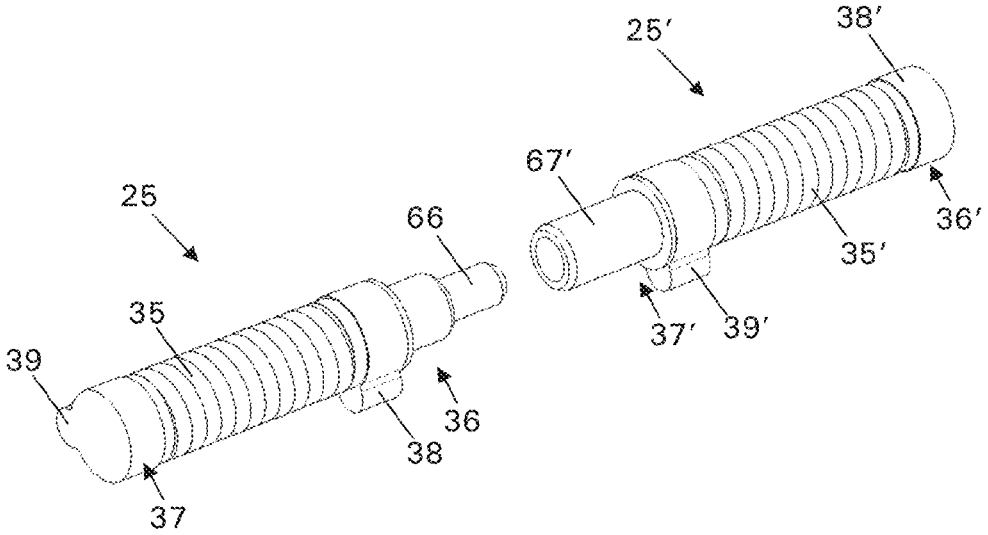
FIG. 35 represents a perspective view of the springs used in the fifth embodiment of the invention.

In this design, the single spring of the preceding embodiment is replaced by two springs 25, 25', represented in FIG. 35. Each of these springs 25, 25' comprises a central part 35, 35' consisting of helical turns, fulfilling the "spring" function, arranged between two ends 36, 37; 36', 37'. Each of these ends comprises a substantially cylindrical shape, the circumference of which comprises at least one protuberance, respectively 38, 39, 38' (not visible), 39'. The two ends 36, 37' of respectively the two springs 25, 25', comprise extensions 66, 67' forming additional link means, making it possible to link the two springs 25, 25'. In this embodiment, the first spring 25 comprises an extension 66 forming an axial protuberance provided to be housed in a bore of the extension 67' of the second spring 25'. This linking of the two springs is particularly visible in FIG. 34.

Figure 36A:
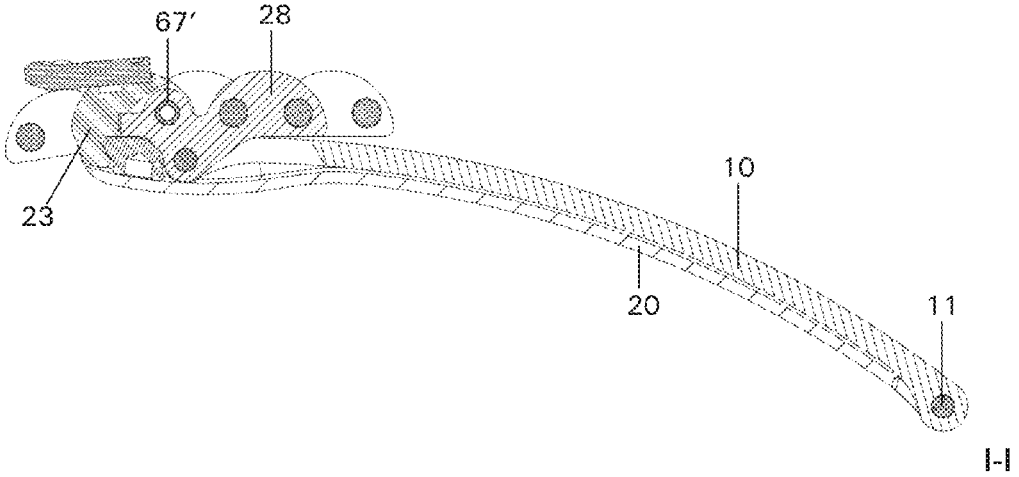
Figure 36B:
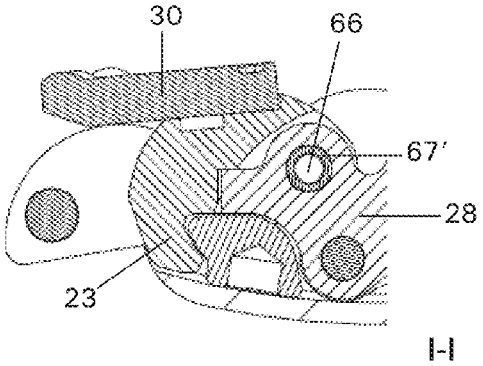

FIGS. 36*a* and 36*b* represent a cross-sectional view of this clasp in a longitudinal plane I-I in its central part. This cross-sectional plane goes through the extension 67' of the second spring 25. It will also be noticed that the central link 28 of the clasp surrounds this extension 67'.

Figure 37A:
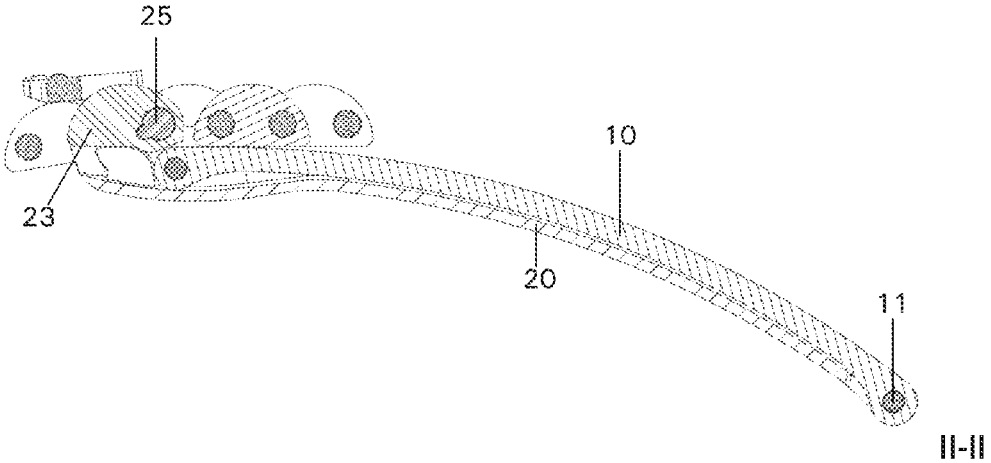
Figure 37B:
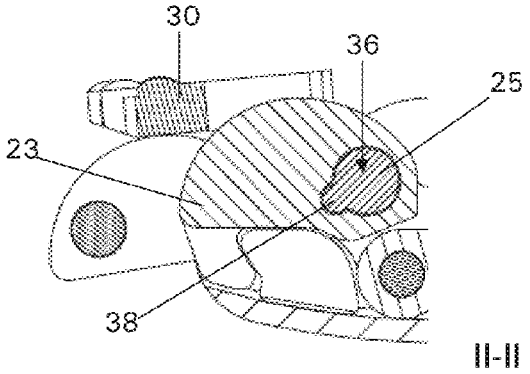

FIGS. 37*a* and 37*b* show a cross-sectional view of the clasp in a longitudinal plane II-II at a first end 36 of the first spring 25. The protuberance 38 of the spring 25 cooperates with a corresponding opening arranged in the attachment lever 23, which makes it possible to block the rotation of this end of the spring 25. Substantially symmetrically, the protuberance 39' of the second spring 25' is also housed in a key-form-forming opening of this same attachment lever 23.

Figure 38A:
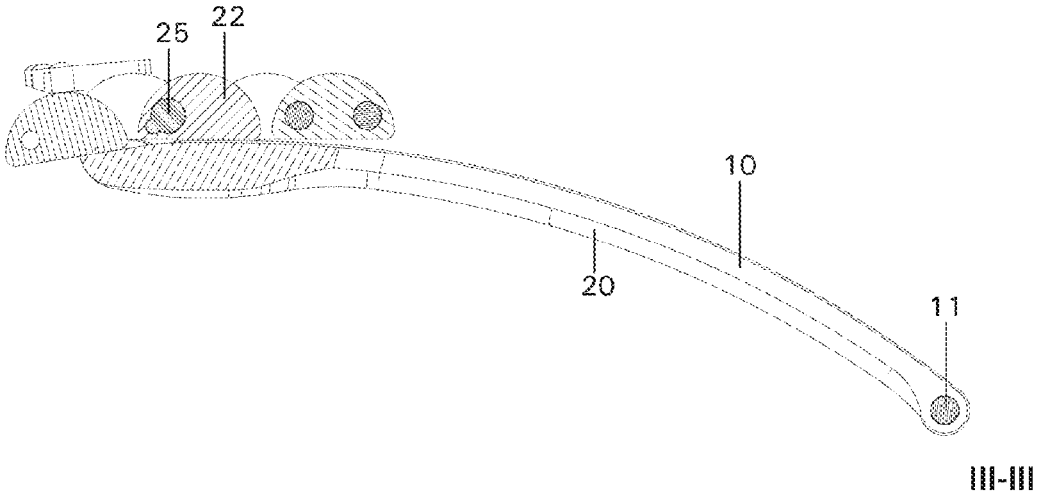
Figure 38B:
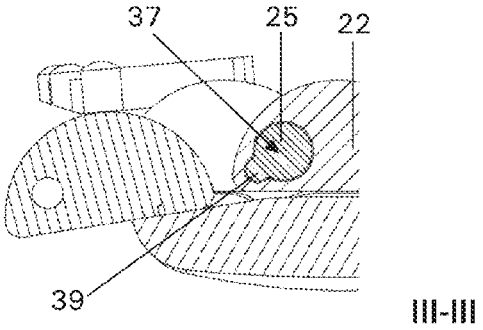
Figure 39:
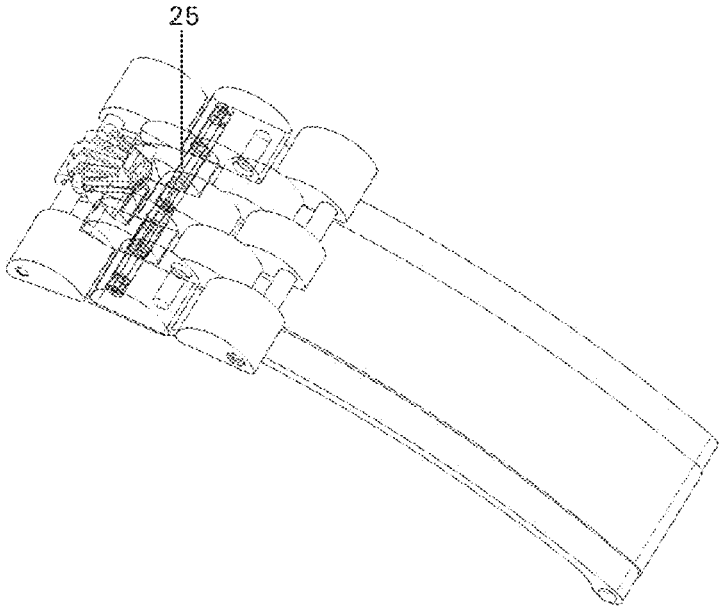
FIG. 39 represents a plan perspective view of a clasp according to a sixth embodiment of the invention.
Figure 40:
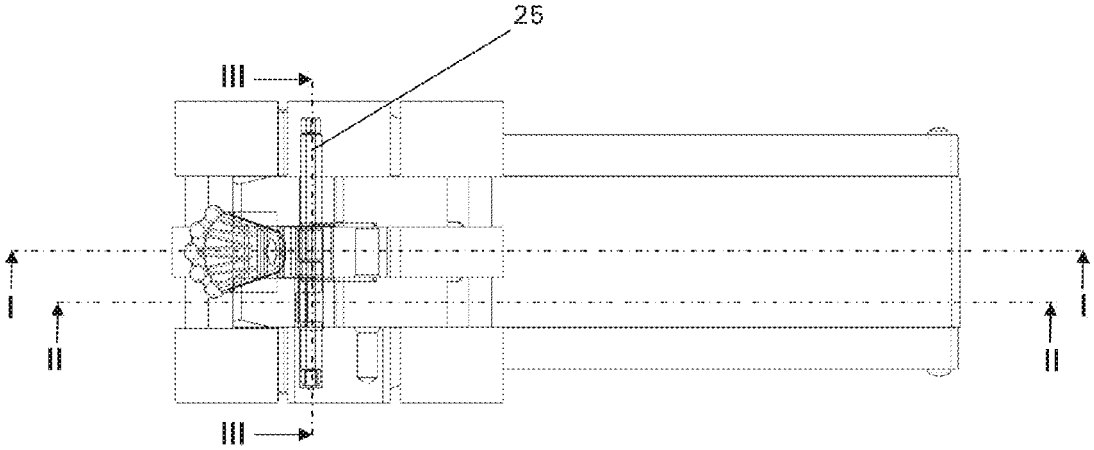
FIG. 40 represents a plan view of the clasp according to the sixth embodiment in which the significant elements of the solution are shown by transparency, in particular the torsion spring.
Figure 41:
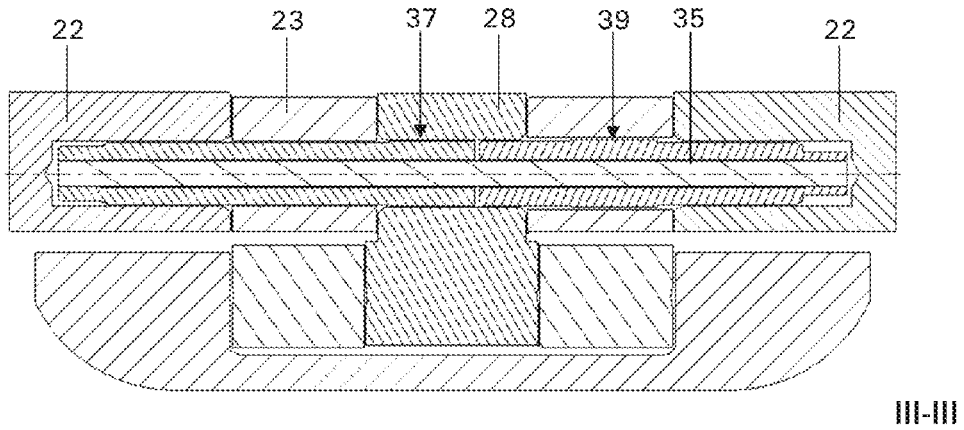
FIG. 41 represents a cross-sectional view in a transversal plane III-III comprising the torsion spring of the sixth embodiment of the invention.

FIGS. 38*a* and 38*b* show a cross-sectional view of the clasp at the second end 37 of the first spring 25. The protuberance 39 of the spring cooperates with a corresponding opening arranged in an edge link 22, which makes it possible to block the rotation of this end of the spring 25. Substantially symmetrically, the protuberance 38' of the second spring 25' is also housed in a key-form-forming opening of an opposite edge link 22.

FIGS. 39 to 45 illustrate a clasp according to a sixth embodiment of the invention. They illustrate this sixth embodiment in the case of a clasp without cover, similar to the design according to the preceding embodiment.

Figure 42:
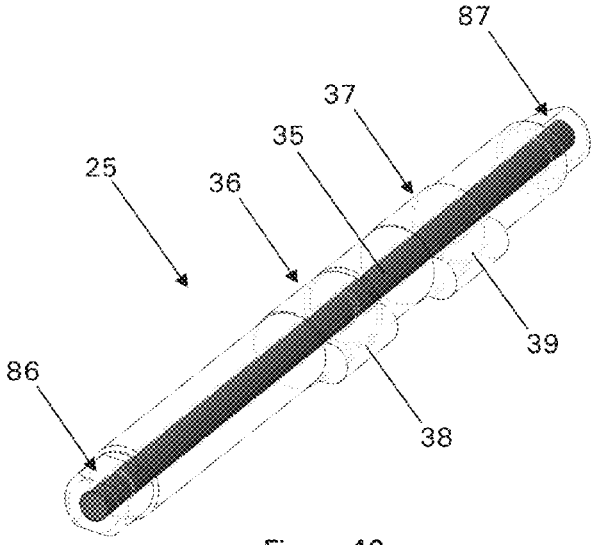
FIG. 42 represents a perspective view of a first variant spring used in the sixth embodiment of the invention.
Figure 43:
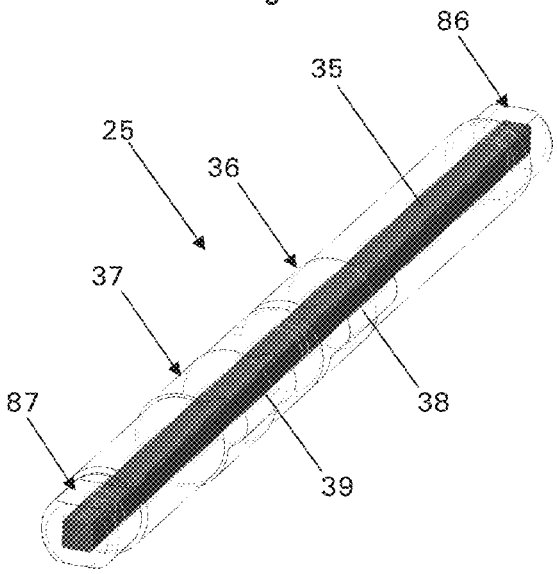
FIG. 43 represents a perspective view of a second variant spring used in the sixth embodiment of the invention.

This clasp is distinguished from the preceding design in that it uses a single torsion spring arranged differently, which alone fulfills the function of articulation shaft. In this design, the single spring 25, two variant designs of which are represented in FIGS. 42 and 43, comprises a central part 35 consisting of a torsion wire, fulfilling the "spring" function, onto which are added the first and second parts 36, 37. For example, these parts can be added on by welding, notably by laser welding, or even by brazing or bonding. They can also be securely attached to the torsion wire by material compression. To this end, geometrical configurations, notably flats 86, 87, are provided on the parts 36 and 37 so as to allow for a compression of the torsion wire at its ends.

FIG. 42 illustrates a first variant design of the spring in which the section of the torsion wire is circular. The section of the torsion wire has, for example, a diameter of the order of 0.5 mm. FIG. 43 illustrates a second variant design of the spring in which the section of the torsion wire is square. Obviously, this section can have any kind of geometry adapted so as to generate an appropriate return torque. The section of the torsion wire can also be solid or hollow. Advantageously, this torsion wire can be machined from a spring material such as that known by its brand name Nivaflex. It could also be made of Phynox or of any other cobalt-based alloy. This torsion wire could also be machined from an alloy with shape memory such as that known by its brand name Nitinol, or even of titanium. This torsion wire can also be strain-hardened.

Figure 44A:
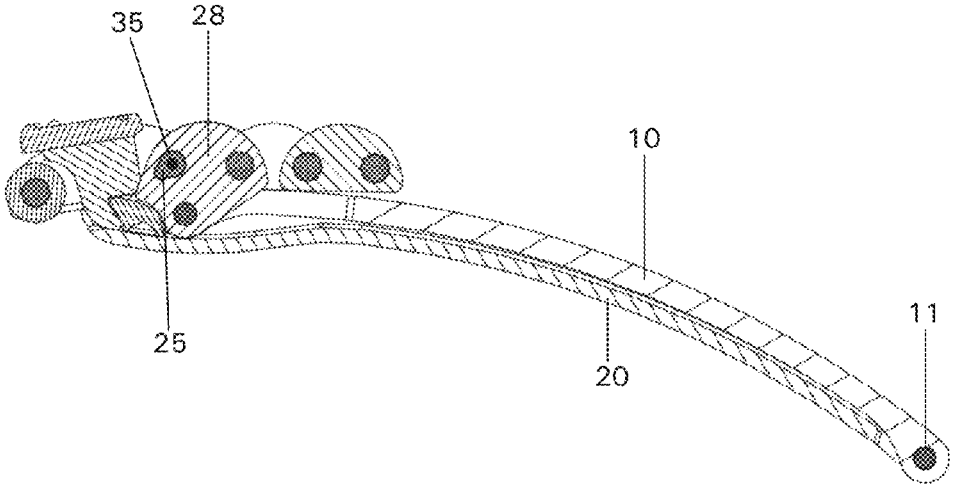
FIGS. 44*a* and 45*a* represent cross-sectional views respectively in longitudinal planes I-I, II-II of the clasp according to the sixth embodiment of the present invention.
Figure 44B:
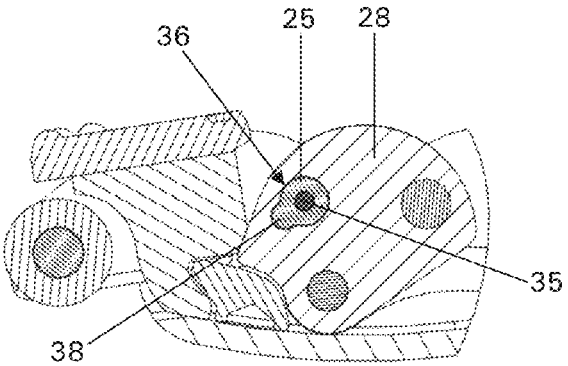
FIGS. 44*b* and 45*b* represent enlarged views of the clasp according to the preceding cross-sectional views.

FIGS. 44*a* and 44*b* show a cross-sectional view of the clasp in a longitudinal plane I-I in its central part. This cross-sectional plane goes through a first part 36 of the spring 25. It can be seen that this part 36 is arranged in such a way that its protuberance 38 is housed in an opening formed within the central link 28, this opening forming a key form for the protuberance 38. This architecture makes it possible to block the rotation, that is to say in both directions of rotation, of the part 36 of the spring 25 relative to the central link 28, and also relative to the edge links 22 of the clasp, the latter being securely attached to the central link 28 by a connecting assembly shaft.

Figure 45A:
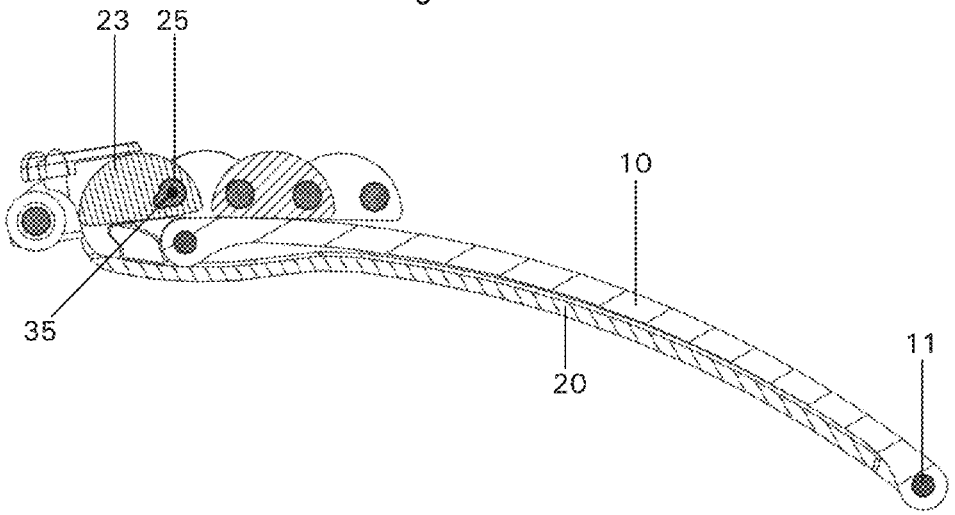
Figure 45B:
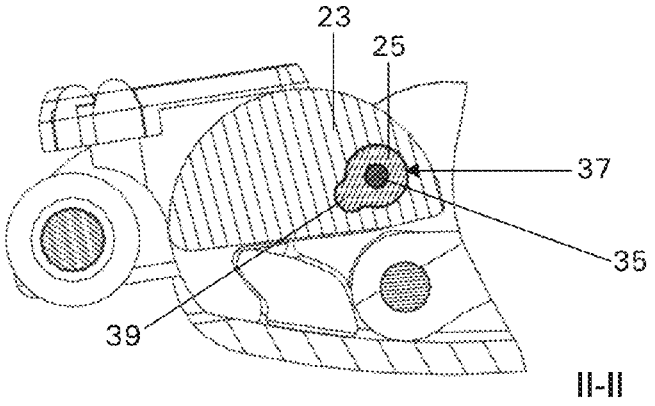

FIGS. 45*a* and 45*b* show a cross-sectional view of the clasp in a longitudinal plane II-II in a second part 37 of the first spring 25. The protuberance 39 of the spring 25 cooperates with a corresponding opening arranged in the attachment lever 23, this opening forming a key form for the protuberance 39. This architecture makes it possible to block the rotation, that is to say in both directions of rotation, of the part 37 of the spring 25 relative to the attachment lever 23. By this construction, the guiding of the rotation of the attachment lever 23 is ensured by the external diameter of the parts 36, 37 or of a portion of the parts 36, 37 (excluding the protuberances 38, 39). Moreover, the parts 36 and 37 also implement the link shaft between the two components.

Finally, in all the embodiments, at least one torsion spring is used, to implement an elastic articulation between two components of a horological mechanism, which offers the advantage of minimizing the bulk compared to the prior art solutions. This spring can, for example, comprise helical turns or else one, or even several, torsion wire(s).

In all the embodiments, a spring has at least one protuberance which is provided to be engaged in a substantially complementary, even complementary, key form, to angularly block the corresponding area of the spring on the component with which it is linked, that is to say block its rotation, in both directions of rotation. As mentioned previously, in a variant design, this key form can allow the protuberance a certain angular travel. In this variant, the key form therefore defines two abutments which each block a rotation in a given direction of the spring and which limit the rotation in a certain angular travel between the two abutments. This approach makes it possible to angularly index the two articulated components.

Furthermore, particular areas of the spring are also provided to form guiding surfaces, which implement the guiding function for the rotational movement of the two horological components, to do away with defects, dispersions, fluctuations of form of the other parts of the spring, notably the parts comprising the turns in the case of a helical torsion spring, or comprising a torsion wire in another case, this or these other part(s) fulfilling the elastic function. For this, these particular areas advantageously have cylindrically based shapes with different diameters for a link with less play with the horological components. As a remark, such a link with less play means thus that the play is sufficiently low so that the two linked components are movable in rotation one relative to the other, but with a very reduced mobility in other directions, in order to ensure a guiding function of the rotation movement. Preferably, this play is less than 0.15 mm, or 0.1 mm, for example around a nominal play of 0.07 mm. If the guiding surface of the spring and the corresponding surface of the horological component linked with less play are sensibly cylindrical, respectively of diameter D1 and D2, it will preferably be chosen $|D1-D2| \leq 0.15$ mm or 0.1 mm.

Naturally, certain elements of the solutions described previously can, as a variant, be in another form. Notably, as has been seen, one or more torsion springs can be used. In the case of a plurality of springs, they can be independent or joined together. Also, certain areas have been designed to angularly block and/or guide the rotational movement of the horological components: these areas have been positioned toward the ends and/or at the center of the spring. They could, as a variant, be located at any other point of the spring. Furthermore, at least one protuberance has been used to form an angular blocking element. As a variant, any radial or longitudinal protuberance, a set of teeth, a flat, a countersink and/or a bore, etc., can be used.

Furthermore, as explained previously, the rotational blocking should be interpreted as an arrangement which makes it possible either to totally block any rotation, or which makes it possible to limit this rotation by two abutments which each prevent a rotation in a certain direction and ultimately which limit the degree of freedom within a certain angular travel between the two abutments. This angular travel is preferably small, less than or equal to 20 degrees, even 10 degrees.

Furthermore, as has been seen, this or these torsion spring(s) are advantageously arranged along the rotation axis of the two horological components. They can be associated with an articulation shaft that exists physically in the form of a shaft or of a bar or with no other element, then themselves forming the physical articulation shaft of the articulated components. As a variant, this rotation axis is formed, for example, by one or more spring(s) of the arrangement, without the addition of a distinct physical shaft, the rotation axis or link shaft between the two components then not being directly embodied.

The invention has been illustrated on the basis of a bracelet clasp associated with a wrist watch, which is moreover also affected as such by this invention, and more specifically in the locking mechanism of this clasp, between a moving element such as a lever or a cam implementing the locking and unlocking and another distinct fixed component of the clasp. As a variant, this principle can be implemented for any articulated elastic link between two horological components, whether this movement is a pure rotation or more complex, such as a rotation combined with another displacement.

Figure 46:
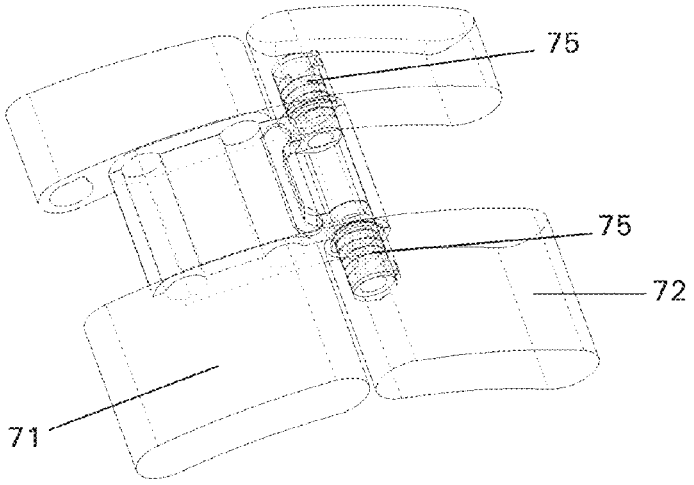
FIG. 46 represents an articulated link between two link assemblies of a bracelet according to a seventh embodiment of the invention.

For example, it can be implemented between two link assemblies of a bracelet, as is schematically illustrated by FIG. 46, which shows two bracelet link assemblies 71, 72 articulated by two torsion springs 75, similar to those represented by FIGS. 27 and 28. Such a solution makes it possible to angularly pre-orient the different link assemblies of an elastic bracelet, which can then be preshaped to the geometry of the wrist of its wearer.

According to another variant, the principle of the invention can be implemented between any two components of a timepiece part. Naturally, numerous other embodiments of the invention can easily be deduced by combining the different designs illustrated previously, or by incorporating any spring described previously between two articulated horological components.

A technical problem arises in optimally manufacturing springs comprising an area formed from helical turns used for implementations of the invention.

A first solution consists in machining a spring material such as that known by its brand name Nivaflex. Slots of the order of 0.4 mm can then be produced, for example by laser cutting.

Figure 47:
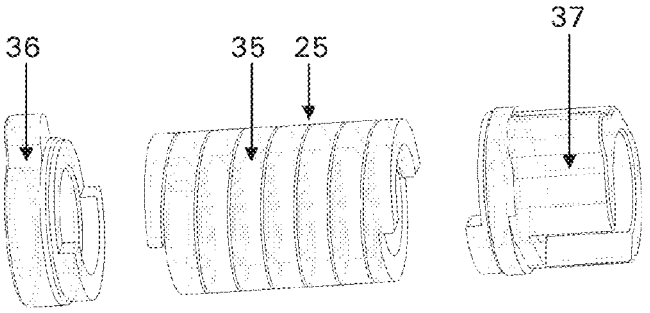
FIG. 47 schematically represents a provisional step of a method for manufacturing a torsion spring according to one embodiment of the invention.

A second solution consists in manufacturing a spring in a plurality of parts. FIG. 47 illustrates, by way of example, the production of a particular spring 25 from three distinct parts. A first step of this method therefore comprises the manufacture of a plurality of distinct parts of the spring, notably by separating the area fulfilling the elastic function from the rotation blocking and/or guiding areas. Thus, by going back to the example illustrated by FIG. 47, a central part 35 is obtained from a previously strain-hardened wound wire. Then, the two ends 36, 37 are machined from a more conventional material, such as a stainless steel. A second step then consists in joining together the distinct parts. This joining together can, for example, be done by laser welding. To minimize the stresses during these welding operations, the ends to be welded of each of these distinct parts can have a cutout in staircase form 81. This manufacturing method uses a wire of preferably square or rectangular section, with a spacing between the turns chosen to obtain the return torque sought. This manufacturing method notably makes it possible to generate a contact between the turns of the spring of the central part 35 to achieve a maximum torsion torque.

The invention claimed is:

1. An arrangement forming an elastic articulated linkage between first and second components of a horological assembly, wherein the arrangement comprises at least one link shaft and at least one torsion spring working in torsion mode between the first and second components to exert an elastic return force, the torsion spring comprising at least one guiding surface to guide, with lesser play, the movement of at least one of the first and second components of the horological assembly, wherein the torsion spring has at least first and second parts each comprising a respective angular blocking element, said at least first and second parts being arranged at any of at least one end and a central area of the torsion spring.

2. The arrangement as claimed claim 1, wherein the torsion spring is a helical torsion spring, and wherein the first part is linked to the first component of the horological assembly and the second part is linked to the second component of the horological assembly.

3. The arrangement as claimed in claim 1, wherein the torsion spring comprises a torsion wire.

4. The arrangement as claimed in claim 3, wherein the torsion spring comprises at least one part added on and fixed around the torsion wire, and wherein an outer surface of the at least one part forms the at least one guiding surface for the movement of at least one component of the horological assembly.

5. The arrangement as claimed in claim 1, wherein at least one part of the torsion spring comprises an angular blocking element to prevent or limit, in both directions, any rotation of the part relative to the horological component with which the part is linked.

6. The arrangement as claimed in claim 5, wherein the angular blocking element of the part of the torsion spring comprises at least one feature selected from a protuberances, a set of teeth, a flat, a countersink, and a cutout, wherein the feature is at least one of radial and axial, and arranged on a substantially cylindrical surface to prevent or limit, in both directions, any rotation relative to the horological component with which the part of the torsion spring is linked.

7. The arrangement for as claimed in claim 1, wherein the at least one torsion spring is a helical torsion spring at the center of which is arranged a bar forming an articulation shaft around which is articulated at least one component of the horological assembly.

8. The arrangement as claimed in claim 1, wherein the torsion spring is in the form of a single monolithic part or two distinct parts linked together.

9. A horological assembly, comprising an arrangement as claimed in claim 1.

10. The horological assembly as claimed claim 9, which is a clasp for a wrist watch bracelet and wherein one of the first and second components is a locking device.

11. The horological assembly as claimed in claim 9, which is a bracelet for a wrist watch and wherein the first and second components of the horological assembly are two link assemblies of the bracelet, juxtaposed and articulated.

12. A wrist watch, comprising the arrangement as claimed in claim 1.

13. The arrangement as claimed in claim 8, wherein the at least one torsion spring is a helical torsion spring.

14. The horological assembly as claimed claim 10, wherein the locking device is a lever for locking and unlocking the clasp.

15. An arrangement forming an elastic articulated linkage between first and second components of a horological assembly, wherein the arrangement comprises at least one link shaft and at least one torsion spring working in torsion mode between the first and second components to exert an elastic return force, the torsion spring comprising at least one guiding surface to guide, with lesser play, the movement of at least one of the first and second components of the horological assembly, wherein the torsion spring is a helical torsion spring, and wherein the at least one guiding surface is at least one of (i) an area of the helical torsion spring comprising an outer diameter greater than that of the area or areas of the helical torsion spring comprising turns which fulfill the elastic return function by torsion torque, and (ii) an area of the helical torsion spring comprising an axial cutout having an inner diameter less than an inner diameter of the area or areas of the helical torsion spring comprising turns.

16. The arrangement as claimed in claim 15, wherein the at least one guiding surface is an area of the helical torsion spring comprising an axial cutout having an inner diameter less than an inner diameter of the area or areas of the helical torsion spring comprising turns.

17. An arrangement forming an elastic articulated linkage between first and second components of a horological assembly, wherein the arrangement comprises at least one link shaft and at least one torsion spring working in torsion mode between the first and second components to exert an elastic return force, the torsion spring comprising at least one guiding surface to guide, with lesser play, the movement of at least one of the first and second components of the horological assembly, wherein the at least one guiding surface is merged with a part of the torsion spring comprising an angular blocking element to prevent or limit, in both directions, any rotation of the part relative to the one of the first and second components with which the part is linked.

18. An arrangement forming an elastic articulated linkage between first and second components of a horological assembly, wherein the arrangement comprises at least one link shaft and at least one torsion spring working in torsion mode between the first and second components to exert an elastic return force, the torsion spring comprising at least one guiding surface to guide, with lesser play, the movement of at least one of the first and second components of the horological assembly, wherein the at least one torsion spring comprises at least a part forming the link shaft between the first and second components.

19. A horological assembly, comprising an arrangement forming an elastic articulated linkage between first and second components of a horological assembly, wherein the arrangement comprises at least one link shaft and at least one torsion spring working in torsion mode between the first and second components to exert an elastic return force, the torsion spring comprising at least one guiding surface to guide, with lesser play, the movement of at least one of the first and second components of the horological assembly, wherein the horological assembly is a clasp for a wrist watch bracelet and at least one of the first and second components is a locking device, wherein the clasp comprises at least two blades that move relative to one another, the locking device being arranged at a free end of a moving blade, the arrangement being arranged between the moving blade and the locking device, and wherein a first part of the torsion spring has a first angular blocking element for cooperation with first key forms of a first link of the clasp.

20. The horological assembly as claimed in claim 19, wherein the at least one torsion spring includes a first torsion spring and a second torsion spring working in torsion, and wherein the first and second torsion springs are aligned in a transversal direction of the clasp, two lateral ends of the first and second torsion springs each having a respective first angular blocking element for cooperation with respective first key forms of respective first links each of which is an edge link of the clasp and two central ends of the first and second torsion springs each having a respective second blocking element cooperating with respective second key forms of a second link which is a central moving link assembly bearing an attachment element of attachment lever type for locking the clasp.

21. The horological assembly as claimed in claim 19, wherein the at least one torsion spring is a single torsion spring, wherein at least one lateral end of the torsion spring has the first blocking element for cooperation with the first key forms of the first link which is an edge link of the clasp and a rigid area of the torsion spring has a second blocking element cooperating with a central moving link assembly comprising an attachment element for locking the clasp.

22. The horological assembly as claimed in claim 19, wherein the at least one torsion spring is a single torsion spring, wherein at least a first lateral end of the torsion spring has the first blocking element for cooperation with the first key forms of the first link which is an edge link of the clasp and a second lateral end of the torsion spring has a second blocking element cooperating with second key forms of a link assembly bearing an attachment element of attachment lever type for locking the clasp.

23. The horological assembly as claimed in claim 19, wherein at least one lateral end of the torsion spring comprises a guiding transversal cylindrical portion for cooperating with openings in edge link assemblies.

24. The horological assembly as claimed in claim 19, wherein the at least one torsion spring comprises a torsion wire covered by a securely attached first part having the first blocking element for cooperation with the first key forms of the first link which is a central link of the clasp and covered by a securely attached second part having a second blocking element cooperating with an attachment element of attachment lever type for locking the clasp.

25. A horological assembly, comprising an arrangement forming an elastic articulated linkage between first and second components of a horological assembly, wherein the arrangement comprises at least one link shaft and at least one torsion spring working in torsion mode between the first and second components to exert an elastic return force, the torsion spring comprising at least one guiding surface to guide, with lesser play, the movement of at least one of the first and second components of the horological assembly, wherein the horological assembly is a clasp for a wrist watch bracelet and at least one of the first and second components is a locking device, wherein the clasp comprises at least two blades that move relative to one another, the locking device being arranged at a free end of a moving blade, the arrangement being arranged between the moving blade and the locking device, and wherein the at least one torsion spring includes a first torsion spring and a second torsion spring working in torsion, and wherein the first and second torsion springs linked to one another by being torsionally connected to one another.

26. The horological assembly as claimed in claim 25, wherein the connection means is a protuberance on one of the first and second torsion springs cooperating with a corresponding bore on the other of the first and second torsion springs.

27. A horological assembly, comprising an arrangement forming an elastic articulated linkage between first and second components of a horological assembly, wherein the arrangement comprises at least one link shaft and at least one torsion spring working in torsion mode between the first and second components to exert an elastic return force, the torsion spring comprising at least one guiding surface to guide, with lesser play, the movement of at least one of the first and second components of the horological assembly, wherein the horological assembly is a clasp for a wrist watch bracelet and at least one of the first and second components is a locking device, wherein the clasp comprises at least two blades that move relative to one another, the locking device being arranged at a free end of a moving blade, the arrangement being arranged between the moving blade and the locking device, and wherein at least one lateral end of the torsion spring comprises a circular cutout having an inner diameter less than the diameter of turns of a part of the spring fulfilling the elastic return function.

28. The horological assembly as claimed in claim 27, wherein a bar forming an articulation shaft for at least one of the first and second components is arranged within the circular cutout.

29. An arrangement forming an elastic articulated linkage between first and second components of a horological assembly, wherein the arrangement comprises at least one link shaft and at least one torsion spring working in torsion mode between the first and second components to exert an elastic return force, the torsion spring comprising at least one guiding surface to guide, with lesser play, the movement of at least one of the first and second components of the horological assembly, wherein the torsion spring has at least two parts each comprising a respective angular blocking element, said at least two parts being arranged at any of at least one end and a central area of the torsion spring, wherein the torsion spring comprises a torsion wire oriented along a main axis of the elastic torsion return force.

30. An arrangement forming an elastic articulated linkage between first and second components of a horological assembly, wherein the arrangement comprises at least one link shaft and at least one torsion spring working in torsion mode between the first and second components to exert an elastic return force, the torsion spring comprising at least one guiding surface to guide, with lesser play, the movement of at least one of the first and second components of the horological assembly, wherein the torsion spring has at least two parts each comprising a respective angular blocking element, said at least two parts being arranged at any of at least one end and a central area of the torsion spring, wherein the at least one guiding surface comprises a portion of a substantially cylindrical radial surface arranged on a part of the torsion spring and cooperating with a corresponding portion of a substantially cylindrical surface of at least one of the first and second components.

31. An arrangement forming an elastic articulated linkage between first and second components of a horological assembly, wherein the arrangement comprises at least one link shaft and at least one torsion spring working in torsion mode between the first and second components to exert an elastic return force, the torsion spring comprising at least one guiding surface to guide, with lesser play, the movement of at least one of the first and second components of the horological assembly, wherein the torsion spring has at least two parts each comprising a respective angular blocking element, said at least two parts being arranged at any of at least one end and a central area of the torsion spring, wherein the elastic return force of the torsion spring tends to return one of the first and second components toward the other of the first and second components.

32. The arrangement as claimed in claim 31, wherein one of the first and second components is a bracelet clasp locking device.

33. An arrangement forming an elastic articulated linkage between first and second components of a horological assembly, wherein the arrangement comprises at least one link shaft and at least one torsion spring working in torsion mode between the first and second components to exert an elastic return force, the torsion spring comprising at least one guiding surface to guide, with lesser play, the movement of at least one of the first and second components of the horological assembly, wherein the torsion spring has at least two parts each comprising a respective angular blocking element, said at least two parts being arranged at any of at least one end and a central area of the torsion spring, wherein the torsion spring is arranged between two bracelet links, and the at least one guiding surface comprises a first guiding surface cooperating with the first link and a second guiding surface cooperating with the second link.

* * * * *